US010894219B1

(12) United States Patent
Parker et al.

(10) Patent No.: US 10,894,219 B1
(45) Date of Patent: Jan. 19, 2021

(54) FINGER FLYING HOVER TOY

(71) Applicants: David Thomas Parker, Windham, NH (US); Jacob Thomas Parker, Windham, NH (US); Joshua David Parker, Windham, NH (US)

(72) Inventors: David Thomas Parker, Windham, NH (US); Jacob Thomas Parker, Windham, NH (US); Joshua David Parker, Windham, NH (US)

( * ) Notice: Subject to any disclaimer, the term of this patent is extended or adjusted under 35 U.S.C. 154(b) by 292 days.

(21) Appl. No.: 16/115,779

(22) Filed: Aug. 29, 2018

Related U.S. Application Data

(60) Provisional application No. 62/606,008, filed on Sep. 5, 2017.

(51) Int. Cl.
*A63H 27/00* (2006.01)
*A63H 30/04* (2006.01)

(52) U.S. Cl.
CPC ..... *A63H 27/12* (2013.01); *A63H 30/04* (2013.01)

(58) Field of Classification Search
USPC ..... 446/37
See application file for complete search history.

(56) References Cited

U.S. PATENT DOCUMENTS 3,488,882 A * 1/1970 Scott ..... A63H 29/00 446/179
3,803,758 A * 4/1974 Chang ..... A63H 17/395 446/58
4,205,484 A * 6/1980 Kovac ..... A63H 33/18 446/46
4,212,131 A * 7/1980 Ross, Jr. ..... A63H 33/18 446/46
4,281,472 A * 8/1981 Hill ..... A63H 33/40 446/26
4,412,443 A * 11/1983 Stoehr ..... B21D 5/08 72/181
4,413,443 A * 11/1983 Kulesza ..... A44C 9/0061 446/26
4,504,239 A * 3/1985 Kulesza ..... A63H 33/003 446/232
4,506,894 A * 3/1985 Laux ..... A63B 65/08 473/589
5,088,952 A * 2/1992 Goldblatt ..... A63H 1/00 446/220
5,176,559 A * 1/1993 Lane ..... A63H 27/00 446/35
5,297,759 A * 3/1994 Tilbor ..... B64C 27/16 244/17.11
6,843,699 B2 * 1/2005 Davis ..... A63H 27/04 244/23 C
6,868,314 B1 * 3/2005 Frink ..... B64C 1/00 701/3
7,255,623 B2 * 8/2007 Davis ..... A63H 27/04 244/23 C
7,497,759 B1 * 3/2009 Davis ..... A63H 27/12 244/23 C (Continued)

*Primary Examiner* — John E Simms, Jr.
*Assistant Examiner* — Dolores R Collins
(74) *Attorney, Agent, or Firm* — Luis Figarella

(57) ABSTRACT

A flying toy system capable of independently hovering at a programmable height and respond to the manipulations and/or actions of one or more users through their fingers or similar digit extensions, all while continuing an autonomous flight regime.

5 Claims, 14 Drawing Sheets

(56) References Cited

U.S. PATENT DOCUMENTS 7,628,671 B2 * 12/2009 Choi ..... A63H 27/14 124/26
8,169,406 B2 * 5/2012 Barney ..... A63F 13/219 345/158
8,214,088 B2 * 7/2012 Lefebure ..... A63H 27/12 244/189
8,308,522 B2 * 11/2012 Van de Rostyne .... A63H 27/06 244/17.23
8,357,023 B2 * 1/2013 Van de Rostyne .... A63H 27/12 244/17.11
9,004,973 B2 * 4/2015 Condon ..... A63H 30/04 446/37
9,061,558 B2 * 6/2015 Kalantari ..... A63H 27/12
9,072,981 B2 * 7/2015 Tanous ..... A63H 30/04
9,072,987 B2 * 7/2015 Li ..... B01D 19/0031
9,073,532 B2 * 7/2015 Pedersen ..... B60V 1/06
D740,892 S * 10/2015 Chen ..... D21/444
9,216,363 B2 * 12/2015 Sullivan ..... A63H 27/00
9,533,234 B2 * 1/2017 Tanous ..... A63H 30/04
9,753,457 B2 * 9/2017 Burch ..... B64C 19/00
9,782,636 B2 * 10/2017 Martino ..... A63H 27/14
9,943,731 B2 * 4/2018 Martino ..... A63H 27/14
9,944,366 B2 * 4/2018 Tang ..... B63C 9/01
10,118,696 B1 * 11/2018 Hoffberg ..... B64C 39/001
10,358,213 B2 * 7/2019 Freeman ..... B64C 27/001
10,561,956 B2 * 2/2020 Barrett ..... B64C 27/00
2002/0104921 A1 * 8/2002 Louvel ..... A63H 27/04 244/12.1
2003/0134561 A1 * 7/2003 Fontaign ..... A63H 33/18 446/46
2003/0162469 A1 * 8/2003 Forti ..... A63H 33/18 446/34
2006/0084352 A1 * 4/2006 Johnson ..... A63H 3/14 446/61
2006/0231677 A1 * 10/2006 Zimet ..... A63H 27/12 244/17.23
2007/0069471 A1 * 3/2007 Brattesani ..... A63F 9/0079 273/317
2007/0105474 A1 * 5/2007 Gotou ..... A63H 30/04 446/37
2009/0068919 A1 * 3/2009 Jermyn ..... A63H 27/00 446/57
2010/0216368 A1 * 8/2010 Del Principe ..... A63H 33/40 446/179
2011/0237151 A1 * 9/2011 Martino ..... A63H 27/00 446/34
2014/0099853 A1 * 4/2014 Condon ..... A63F 13/245 446/37
2014/0131507 A1 * 5/2014 Kalantari ..... A63H 27/12 244/2
2014/0227932 A1 * 8/2014 Sullivan ..... A63H 27/12 446/37
2014/0249693 A1 * 9/2014 Stark ..... B64D 47/02 701/2
2015/0038045 A1 * 2/2015 Lin ..... A63H 27/12 446/37
2016/0023759 A1 * 1/2016 Barrett ..... B64C 27/00 244/17.23
2016/0031554 A1 * 2/2016 Eshkenazy ..... B64C 39/024 244/6
2017/0053572 A1 * 2/2017 Moore ..... G09F 21/06
2017/0190419 A1 * 7/2017 Hundemer ..... B64C 39/024
2017/0247107 A1 * 8/2017 Hauer ..... B64D 35/06
2018/0039271 A1 * 2/2018 Rimoux ..... A63H 30/04
2018/0321691 A1 * 11/2018 Pedersen ..... B64C 15/02
2019/0333494 A1 * 10/2019 Park ..... H04R 29/005

* cited by examiner

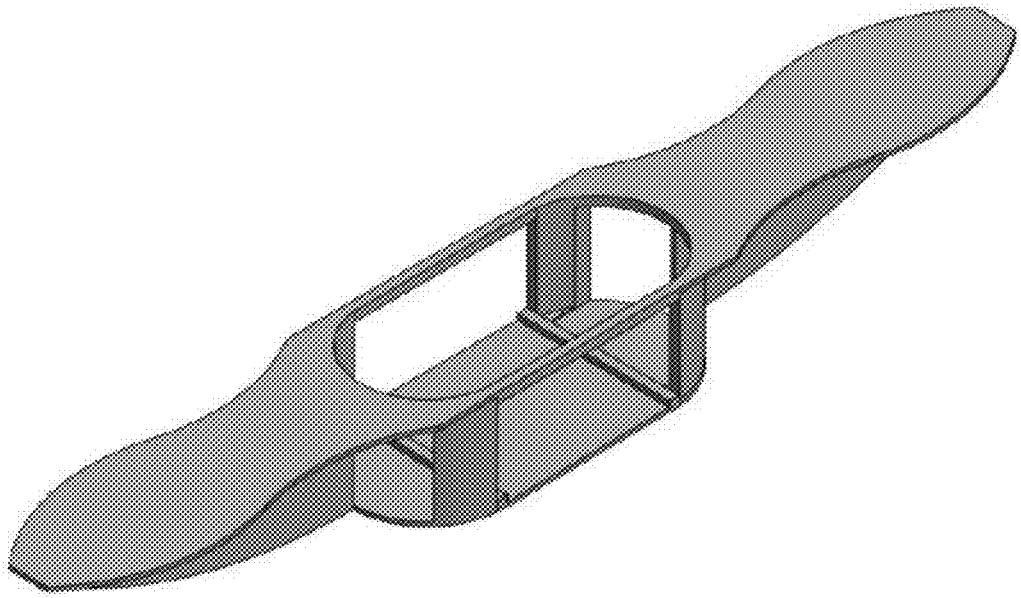
Figure 7
Figure 8
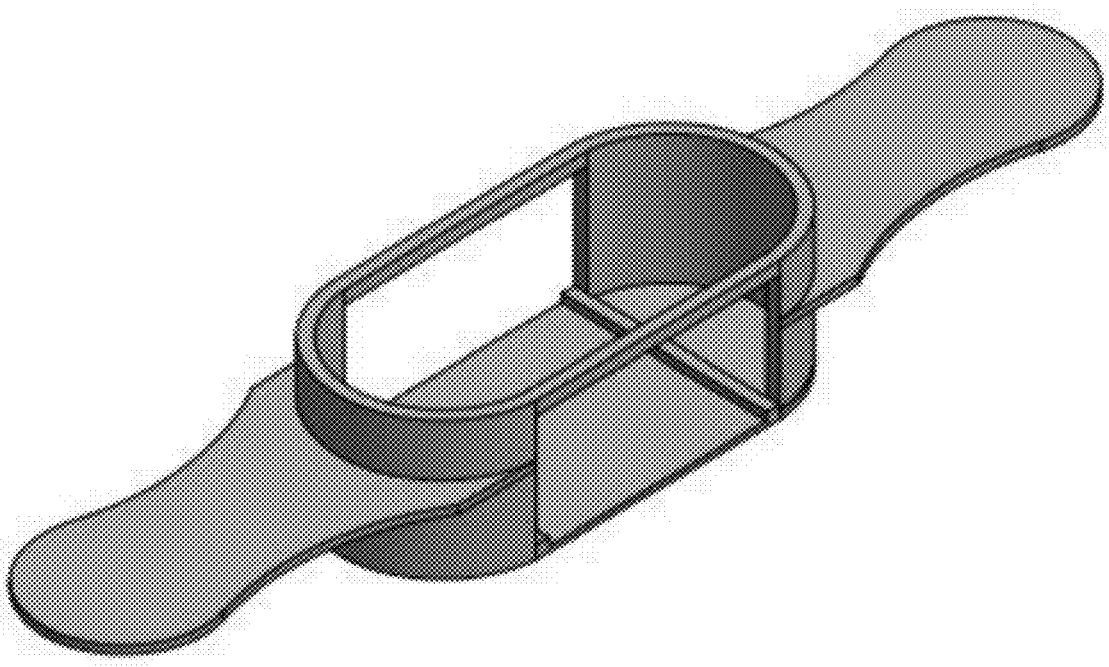

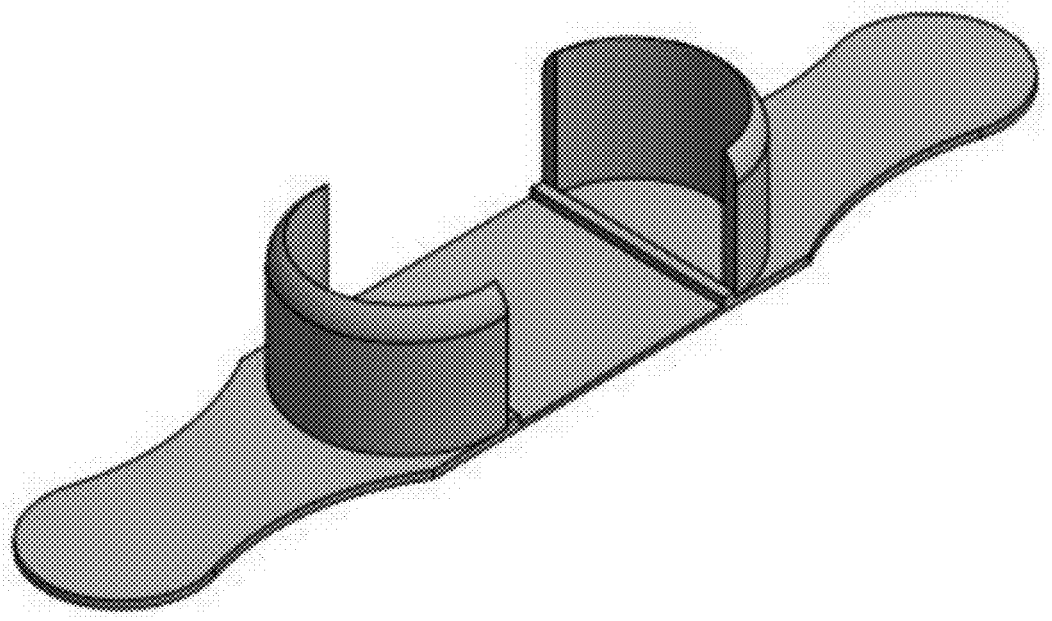
Figure 11
Figure 12
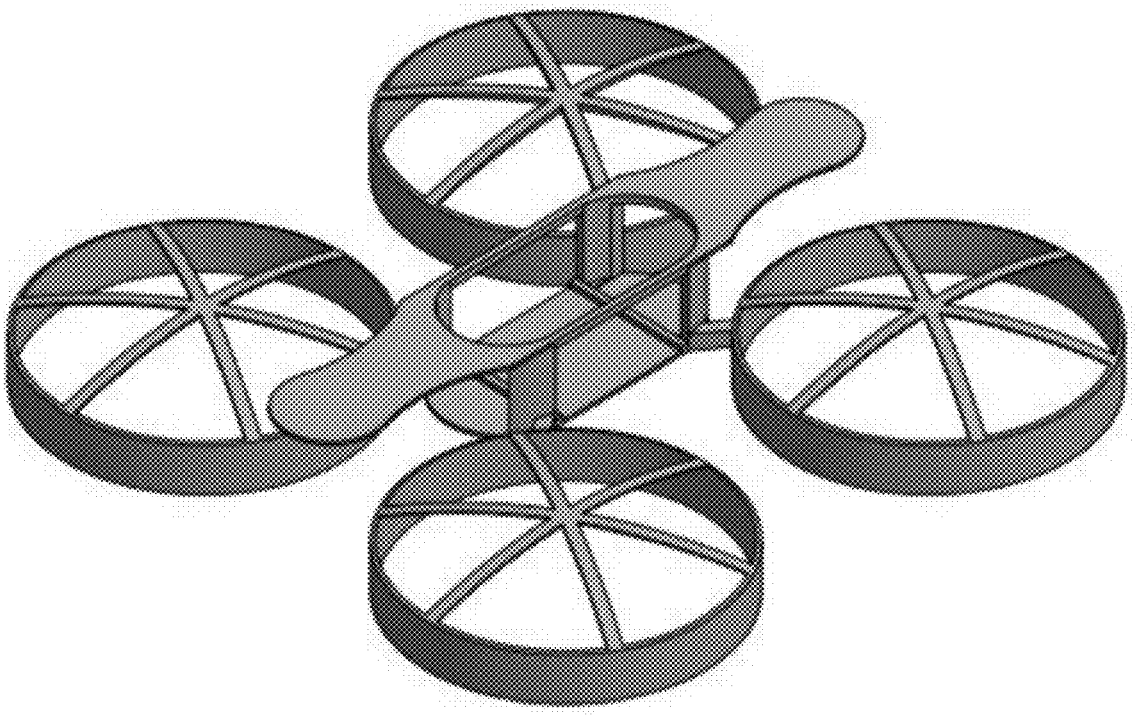

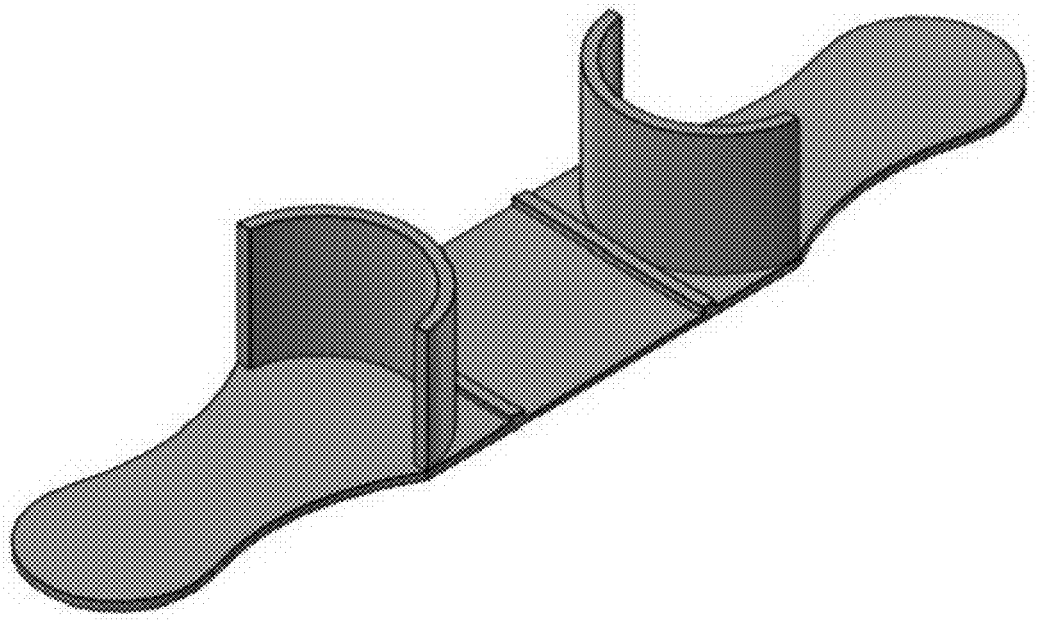
Figure 13
Figure 14
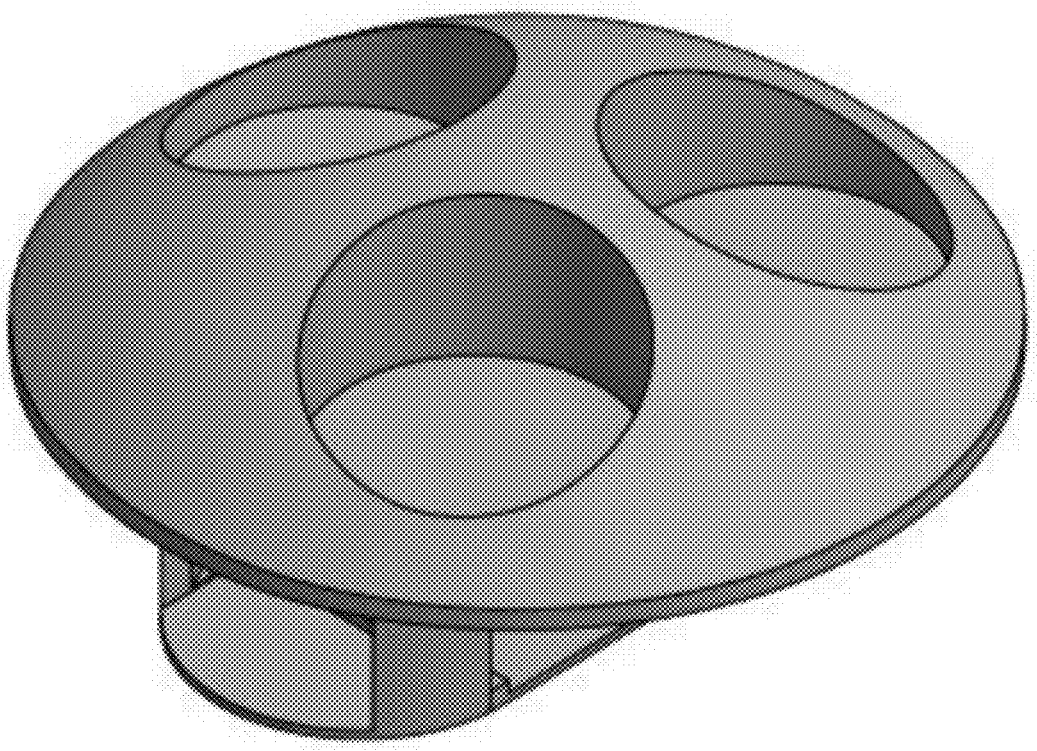

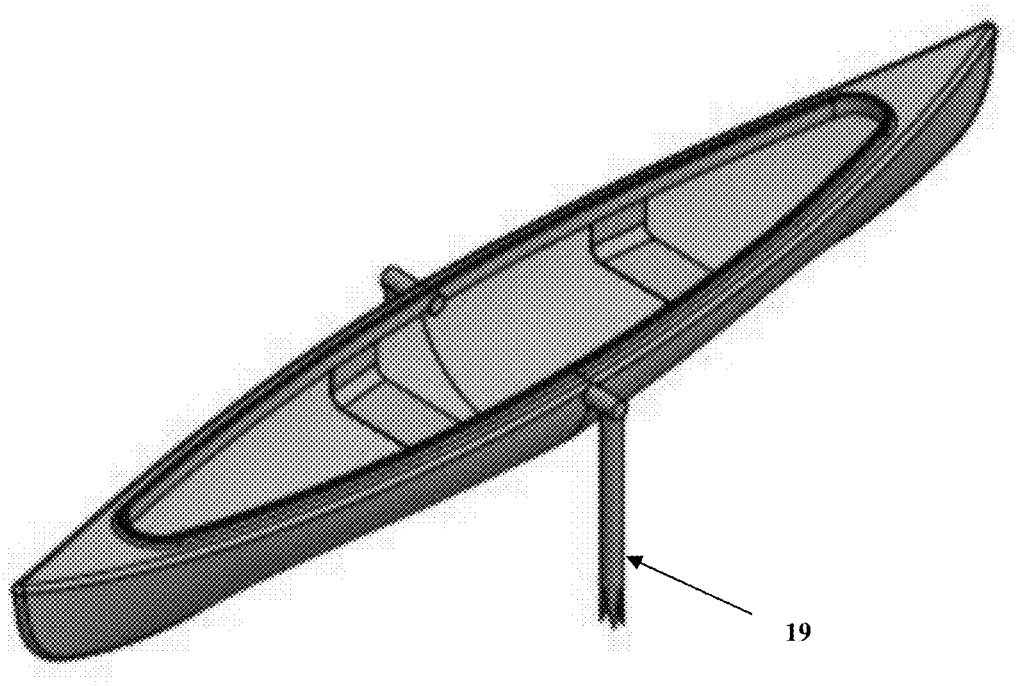
Figure 15
Figure 16
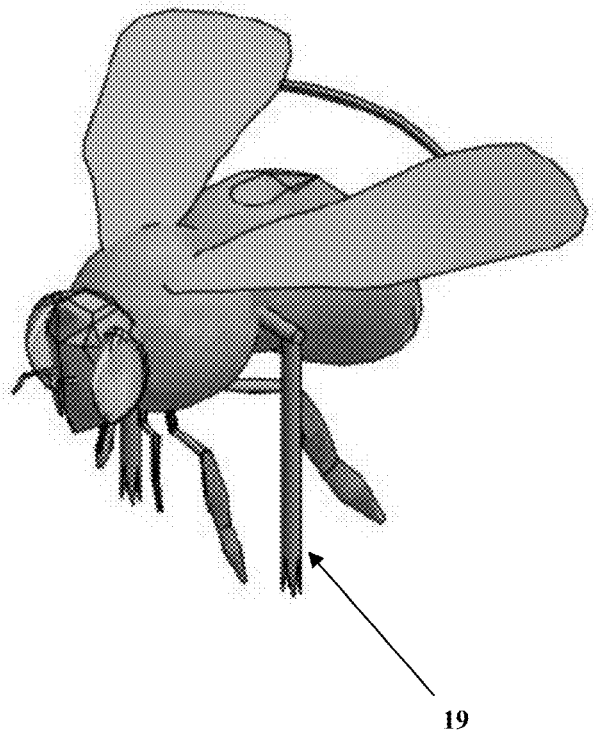

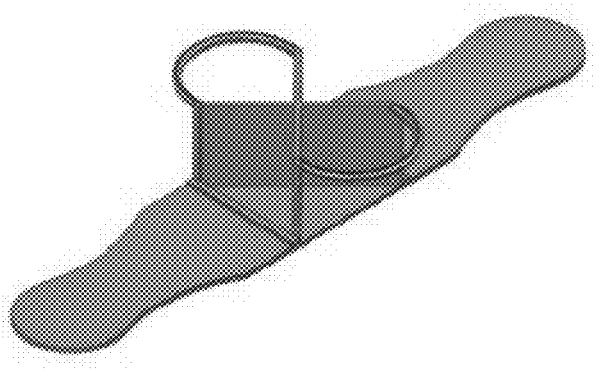
Figure 20
Figure 21
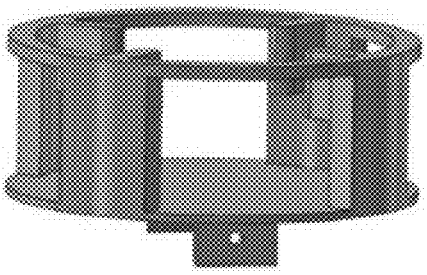
Figure 22
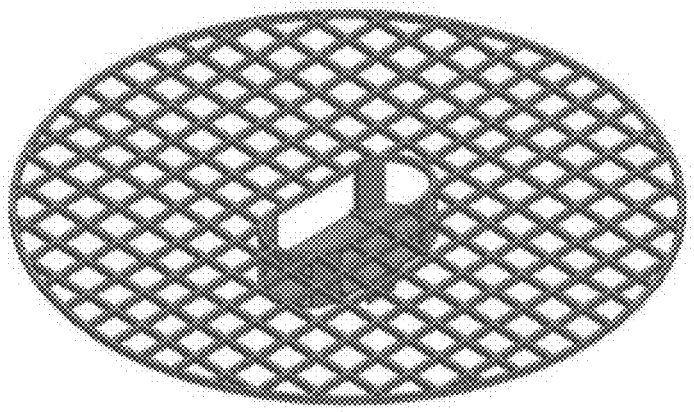

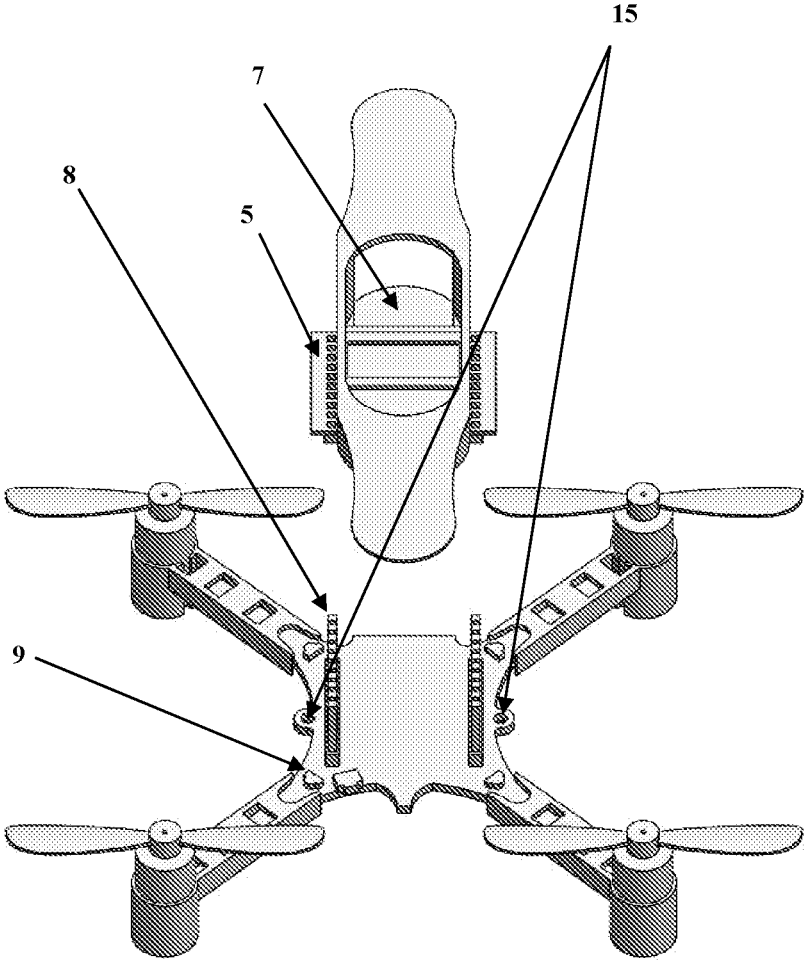
Figure 26
Figure 27
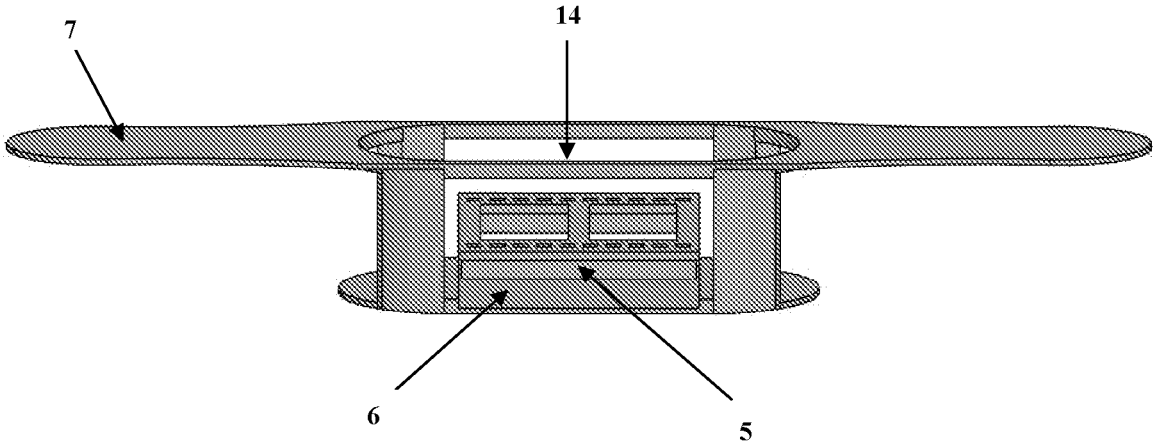

FINGER FLYING HOVER TOY

CROSS-REFERENCE TO RELATED APPLICATIONS

This application claims priority to U.S. Provisional patent application Ser. No. 62/606,008 titled "FINGER FLYING HOVER TOY", filed on Sep. 5, 2017 the disclosure of which is herein incorporated by reference in its entirety.

PATENTS CITED

The following documents and references are incorporated by reference in their entirety, Del Principe (US Pat. Pub. No. 2010/0216368), Gotou et al (US Pat. Pub. No. 2007/0105474), Davis (U.S. Pat. No. 6,843,699), Del Principe (US Pat. Pub. No. 2002/0104921), Kalantari et al (US Pat. Pub. No. 2014/0131507), Barrett et al (US Pat. Pub. No. 2016/0023759), Alexander et al (GB 2552344) and (GB1612535.3).

FIELD OF THE INVENTION

The present invention describes a hovering finger flying toy assembly which is controlled and maneuvered by hand digit insertion into a finger port attached to the top of a miniature roto- or multicopter, which enables an expanded repertoire of tricks and maneuvers.

DESCRIPTION OF THE RELATED ART

The sports of skateboarding, snowboarding, and surfing all have trick maneuvers that momentarily propel and lift the user into the air. The resultant feeling of freedom, accomplishment, and exhilaration from momentarily floating through the air is intense and pleasurable. The desire to escape the earth's surface and seemingly defy the laws of gravity has been a long dreamt fictional fantasy for generations. Fictional American superheroes have been depicted in airborne flight with the aid of self-propelled surfboard-like craft. This fictional concept has universal and timeless appeal. The literary traditions of many other cultures feature flying carpets transporting passengers through the sky.

The collective imagination is set fire with such fantastical thoughts of a human flying through the air with the aid of an open self-propelled platform. A commercially available human transporting "hoverboard" design, which has one or more wheels, has been marketed for years, however it does not actually hover in the air at all. The popularity of these vehicles evidences the deep desire of the general populace to experience hovercraft-type flight. There have been some efforts directed toward the creation of a true levitating human hovercraft, however, achievement in this area is very limited due to lack of control, high instability, unsafe landing/take-off, and a short flight range concomitantly fraught with danger. One way to try to safely replicate, and vicariously experience, these thrills is by pretend play with one's hands using small toy replicas of skateboards, snowboards, skimboards and surfboards thus attempting to mimic the full-scale version.

However, successful efforts to recreate a small self-contained finger flying hovercraft experience are lacking. Some attempted solutions to replicate this experience have not sufficiently enabled pretend play due to a severely limited range of play mobility, instability, intrinsically limited trick maneuvers, and an overall failure to adequately mimic the hovercraft flying toy fantasy. For example, United States patent application US2010/0216368 (Del Principe) describes a hover toy system having a static source of air flow which blows against the bottom of a board-like structure, thus requiring an aerodynamic bottom surface and restricts flight to the area above static air source.

In addition, the system is not amenable to release of finger contact and a shared user experience by passing the board between players. United Kingdom application GB2552344 (Curtis-Oliver) describes a flying toy controlled by the fingers of a user and provides for a finger-contact surface in the form of a common cover affixed over a multicopter with apertures not more than 10 mm. In sharp contrast, this invention is characterized by an upward facing finger port, tab, post, ring, well, or cavity with dimensions greater than 12.5 mm with structural elements wherein finger(s) are inserted into, and can frictionally lock onto, the toy assembly. Likewise, US2004/0131507 (Kalantari), US2002/0104921 (Louvel), and CN104787325 (Hefei) disclose a fly toy in the form of a multicopter containing or surrounded by a common cover or cage-like structure that could be construed as providing a finger-contact surface.

None of these specifications describe or illustrate an upwardly facing finger port, well, or cavity with spatially defined architecture for insertion of fingers into from the top of toy assembly. Our invention disclosure is characterized by location of the finger placement in an upwardly facing port or cavity within a specifically denoted center of mass along the x, y, and z coordinates on the top of the flying toy assembly between spinning propellers. Within our specification, the finger port architecture is specifically optimized for simultaneous interaction with the upper phalangeal portions of user's fingers as well as user's finger tips. This critical difference results in greatly expanded manual maneuverability of the flying toy assembly. For example, it is stated in GB2552344 that tipping the flying toy by one's finger(s) is required to produce translational movement. In our invention, the ability to insert into, and lock onto, the finger port's structural architecture allows horizontal translational movement of flying toy assemble by a frictional pushing interaction with the upper phalangeal portion of user's finger(s), and thusly movement of the toy assembly can smoothly continue after withdrawing finger(s) from the port without significant perturbation of stabilized hover flight.

Accordingly, the flying toy assembly may be passed in midair and reengaged by a second user whom may catch the toy by inserting finger(s) into, and locking onto, the finger port. The position of hand and two fingers within the port(s) as described in our disclosure also mimics a small person riding a hoverboard enhancing the entertainment value of the play experience. Our disclosure also facilitates upward and downward operational movement of the flying toy assembly by locking two fingers into the port and manually overcoming the force of propeller lift or the downward force of gravity. Additionally, insertion of two fingers into the centrally located port over multicopter allows facile and controlled manual yaw spins of the entire flying toy assembly with the flick of user's fingers even after user withdraws hand digits from said port. The enhanced amusement utility that results from new modes of play and trick maneuvers greatly expands the functionality.

In addition, the disclosed invention is capable of being manually passed in midair in a smooth manner between players which enables the benefit of a shared user experience. This disclosure thereby describes a novel conception of a finger flying toy which enables a more realistic hoverboard-like experience with a vastly expanded range of play motion, enhanced visual appeal, and supports an additional repertoire of unique airborne tricks and maneuvers, not facilitated with other finger toys, or even with the known present-day full-scale human standing hovercrafts.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In general form, the present invention consists of a finger-contacting miniature toy with top and bottom elements wherein the bottom side is attached to the top side of a roto- or multicopter. The whole assembly can levitate due to the upward thrust from the mono- or multicopter. The upward propulsion of assembly is derived from one or more propellers accelerating air downward away from assembly with engine placement to allow central finger-contacting toy placement within an unencumbered region of spinning propellers. The entire hovering finger flying toy assembly is controlled by direct contact with user's hand digits which enables the amusement and entertainment utility derived from the mimicry of a small person riding a flying toy.

No external remote control (whether radio wave and/or optical/IR/UV/laser) is required for translation of the toy assembly in the horizontal x-y direction as is normally required for operational control of simple multicopters. The flying toy assembly is able to be hand guided through the air in x-, y-, and z-directional coordinates, and spin around the axis of a top side oriented contacting finger, thus providing additional amusing entertainment for players. The user is also able to remove fingers from contact with toy while in-flight, and the flying toy assembly is able to remain airborne in a stable hover mode, thus allowing subsequent re-engagement of user's fingers with flying finger toy assembly to resume direct finger/hand control of said toy. The finger ports also facilitate a manual user interface to initiate preprogrammed autonomous trick flight maneuvers by sensory input to the onboard electronically integrated 3 or 6-axis gyroscopic, 3-axis accelerometer, and/or 3-axis magnetometer.

In one aspect the invention is about a hand controlled flying toy assembly comprising an electrically powered and controlled rotocopter having one or more propellers powered by one or more engines, electronic control components to activate and control power to said engine propeller(s) of rotocopter, one or more altitude sensor component(s) integrated into said rotocopter electronic components for flying height control and auto hovering stabilization; and one or more finger engagement mechanical components attached to said rotocopter, said finger engagement components having spatially defined finger insertion dimensions. In another aspect, said electronic control components include one or more of the following, power on/off switch, altitude and/or altitude sensor information processing electronics, flight control and/or, engine power control, said altitude component sensors are comprised of one or more of the following: barometric pressure, ultrasound, Infra-red proximity, ToF laser-range and/or other similar sensors and said finger engagement mechanical components include one or more of the following: port, well, dock, tab, post, ring, and/or cavity; having top and/or bottom cavities. In yet another aspect, one or more of said altitude component(s) sensors are projected substantially downward; and said finger attachment component includes an upward orientation onto top-side of said rotocopter wherein finger insertion and gripping can occur from top of the flying toy assembly and are independently greater than one (1) cm and less or equal to twelve (12) cm in height, length, and/or width, whereby frictional contact can occur concurrently with the fingertip(s) and with the upper phalangeal regions below the proximal interphalangeal joint(s) of inserted hand digit(s).

In one aspect, the invention is about a hand controlled flying toy comprising a frame, a finger engagement port, well, dock, tab, post, ring, or cavity with top and/or bottom elements linked to said frame and having spatially defined finger insertion dimensions in height, length, width and/or radius, so that frictional contact can occur concurrently with fingertip(s) and with the upper phalangeal regions below the proximal interphalangeal joint(s) of inserted hand digit(s), one or more mounted electric motors mechanically linked to one or more spinning propeller(s), including required circuitry, gyroscope(s), accelerometer(s) and/or magnetometer (s), integrated with an Inertial Measurement Unit (IMU), flight controller, electronic speed controller and/or any other necessary component(s) required for stabilized hover flight, one or more mechanical component(s) for attachment connecting said finger port, dock, tab, post, ring, well, or cavity in an upward orientation onto top-side of rotocopter so that finger insertion and gripping can occur from top of the flying toy assembly, one or more sensors mounted on said flying toy oriented for detection of external object surfaces and integrated into said flight controller for thrust control modulation; and a power switch and/or sensor(s) to turn on engine propeller(s) to activate and/or facilitate flying mode. In another aspect, said multicopter has between 2 and 12 rotors. In yet another aspect, one or more of said propellers have a shield or guard. In another aspect, said multicopter is a quadcopter. In another aspect, said finger port, dock, tab, post, ring, well and/or cavity, is part of, and/or integrated into the frame of said multicopter so that the top contoured finger port entity, and/or frame, and/or propeller shields are incorporated into one unibody structural element of the finger toy assembly. In yet another aspect, a downward directed sensor is integrated directly into electronic circuitry of said flying toy and can facilitate a preset flying hover distance from ground to rotocopter without the necessity of separate radio remote control.

In another aspect, a user interface having a preprogrammed flight sensory detection of manual contact induced flying toy assembly movement as the input to initiate autonomous flight paths and/or flying trick maneuvers and/or resetting of hover height from ground. In yet another aspect, having a separate remote control and the appropriately integrated receiver elements to enable user to modulate z-directional thrust and change the set height altitude as measured by a downward directed sensor on bottom of rotocopter. In another aspect, having a separate remote control and the appropriate receiver elements to enable user to modulate x-y horizontal and z-vertical directional movement and/or yaw rotation and/or preprogrammed flips of flying toy assembly. In yet another aspect, an equal number of engine propellers are spinning in the opposite directions thus cancelling out torque on said flying toy. In another aspect, all or most of the engine propellers are spinning in the same direction creating a permanent yaw torque on said toy assembly. In yet another aspect, attachment of deck to the frame occurs securely in such a way as to not allow rotation of said deck relative to said frame. In another aspect, the attachment mode of finger port deck to the frame or rotocopter allows for horizontal rotation of said deck plane relative to frame or rotocopter.

In one aspect, the invention is about a finger engagement component comprising; a port, dock, tab, post, ring, well, and/or cavity, with a mode of attachment to any rotocopter, and configured for finger insertion and/or gripping therein, whereby frictional contact can occur concurrently, or independently, with the fingertip(s) and with the upper phalangeal regions below the proximal interphalangeal joint(s), which includes the computer design coordinates and software intended for 3-D printing of said component.

In one aspect, the invention is about a method for using a hand controlled flying toy comprising, placing one or more fingers within port top of deck attached to rotocopter, activating electric engine propeller(s) to levitate toy assembly in a stabilized hover flight, placing at least one finger within the port on deck of levitating toy, enabling frictional contact and mechanical engagement of toy assembly thereby facilitating hand movement control of flying toy in horizontal and vertical directions, using one or more contacting fingers within port to control and actuate the airborne flight movements of hovering toy by body motion of hand, wrist, arm, and/or walking, including the optional spinning of said the toy assembly horizontally around an axis defined by contacting finger, or without finger contact through central z-axis of hovering toy and hand/arm directing the finger-contacted hover toy to careen, bounce, and/or slide off external objects. In another aspect, contact of two or more fingers within port on top deck to resist yaw torque in the case that all or most of the engine propellers are spinning in the same direction then with subsequent lifting of all but one finger allows torque inducted yaw rotation of toy around axis of finger, in the case where an equal number of engine propellers are spinning in opposite directions, thus cancelling out yaw induced torque on said toy, starting with two fingers within port on top deck, user gives horizontal finger flick movement with frictional engagement of port across deck while maintaining one finger on deck results in a user induced yaw spin of the toy around a remaining contacted finger, or removal of fingers to send the hovering toy assembly into a yaw rotation, while one of more fingers are in contact within port on top deck in the upward thrust flying mode, removal of all fingers and hand from vicinity of top deck while flying toy is in stabilized altitude hover mode allowing subsequent replacement of hand/fingers on within port on top deck to regain frictional contact and hand movement control of flying toy, while one or more fingers are inserted into port on top deck, while in the upward stabilized hover flying mode, user can frictionally push flying toy thus translating entire assembly in a horizontal direction, and when user removes hand, flying assembly reverts to automatic stabilized hover altitude while toy continues in its user induced horizontal trajectory without any fingers in contact with toy thus enabling the user to pass the toy to another user who can reengage the flying toy assembly when second user inserts their fingers into port thus completing an in-flight hand-off of the toy from user to another while in continuous airborne flight and while in stabilized hover mode with finger port contact, user may direct flying toy assembly downward by overcoming upward thrust to skid, bounce, or careen off external objects—such as table, ground or floor—using the bottom guards as toy contact element. In yet another aspect, while user has finger(s) locked into port of flying toy assembly in stabilized hover mode, user forces entire toy assembly into a predetermined set of motions that are detected by the onboard inertial measurement unit as an input to initiate preprogrammed autonomous flight paths and/or flying trick maneuvers and/or resetting of hover height from ground, while user removes hand from top of flying toy assembly and after said preprogrammed autonomous flight paths and/or flying trick maneuvers are completed, flying toy assembly automatically reverts to stabilized hover mode wherein the user may reengage control by inserting or docking fingers into port.

Other features and advantages of the present invention will become apparent upon examining the following detailed description of an embodiment thereof, taken in conjunction with the attached drawings.

BRIEF DESCRIPTION OF THE DRAWINGS

A fuller understanding of the foregoing may be had by reference to the accompanying drawings, wherein:

FIG. 7 is a gray-scaled surface isometric view of an alternative bi-level finger engaging toy element.

FIG. 8 is a gray-scaled surface isometric view of an alternative bi-level finger engaging toy element.

FIG. 11 is a gray-scaled surface isometric view of an alternative mono-level finger engaging toy element.

FIG. 12 is a gray-scaled surface isometric view of an alternative bi-level finger engaging toy with a unibody attachment of propeller guards.

FIG. 13 is a gray-scaled surface isometric view of an alternative mono-level finger engaging toy element.

FIG. 14 is a gray-scaled surface isometric view of an alternative finger engaging toy element with multiple finger ports.

FIG. 15 is a gray-scaled surface isometric view of an alternative boat-like finger engaging toy element with side spanning rods 19 for insertion into the top of a quadcopter's frame holes 15 shown in FIG. 26.

FIG. 16 is a gray-scaled surface isometric view of an alternative insect-like finger engaging toy element with side spanning rods for insertion into the top of a quadcopter's frame holes 15 shown in FIG. 26.

FIG. 20 is a gray-scaled surface isometric view of an alternative mono-level finger engaging toy element.

FIG. 21 is a gray-scaled surface isometric view of an alternative mono-level finger engaging toy element.

FIG. 22 is a gray-scaled surface isometric view of an alternative mono-level finger engaging toy element with unibody propeller guards.

FIG. 26 is an elevated end-side view of the FIG. 5 finger engaging toy element and quadcopter as a partial exploded perspective of FIG. 24 depicting connectivity orientation of the battery holder expansion board 5 insertion into the two rows of long expansion connector pins 8 in multi-pin in holes manner.

FIG. 27 illustrates a side elevated view of the finger engaging platform of FIG. 5 with an inserted battery holder expansion board 5 which fit into middle deck section of said toy.

Figure 1:
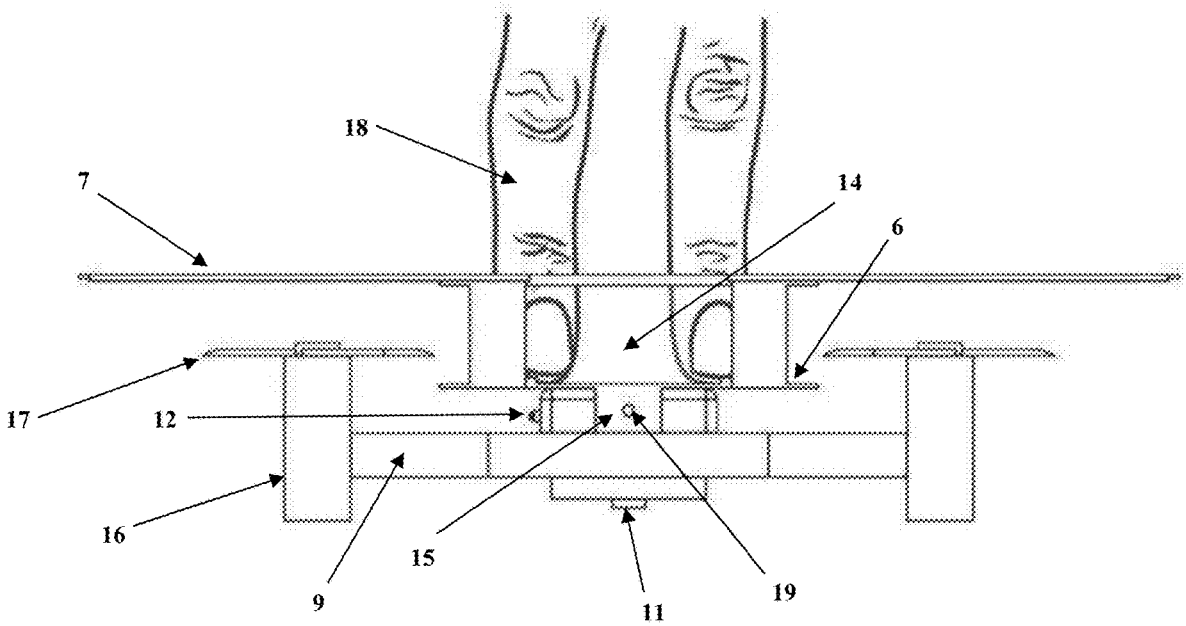
FIG. 1 is a side view of the finger engaging toy element and quadcopter assembly depicting one mode of finger engagement.
Figure 2:
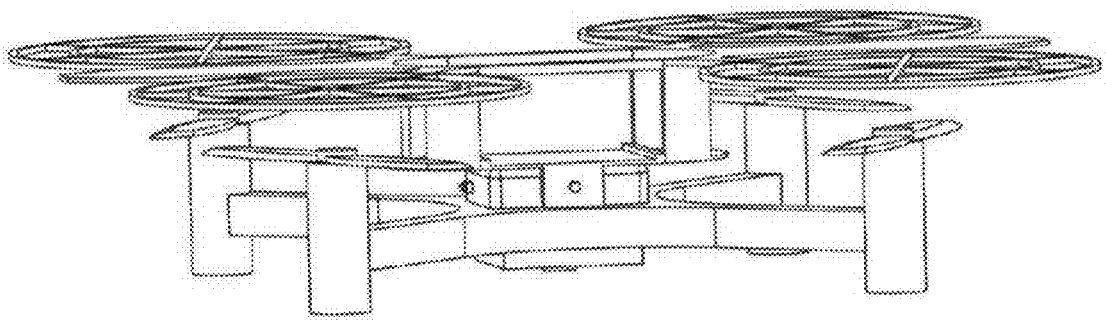
FIG. 2 is an angled view of the finger engaging toy element with unibody attached propeller guards and quadcopter assembly
Figure 3:
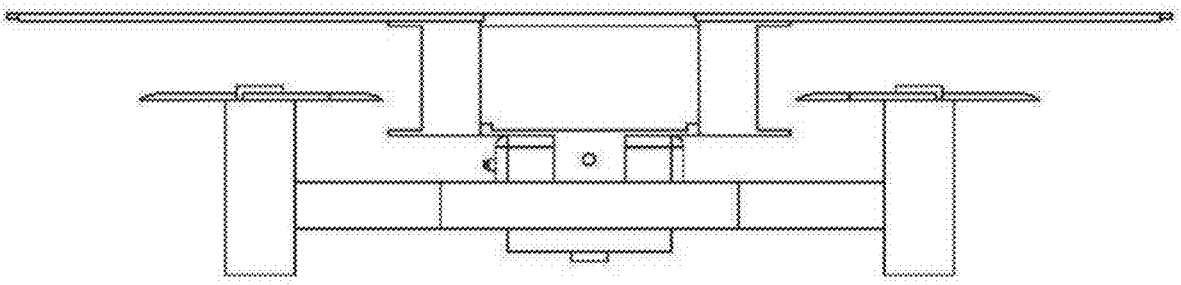
FIG. 3 is a side view of the finger engaging toy element with unibody attached propeller guards and quadcopter assembly

The above-described and other features will be appreciated and understood by those skilled in the art from the following detailed description, drawings, and appended claims

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

For the purposes used within the context of this invention disclosure, any reference to "finger(s)" also includes the potential use and/or presence of the thumb, thereby referring to all hand digits. The present invention comprises a finger-contacting miniature toy with top and bottom elements wherein the bottom side is attached to the top side of a roto- or multi-copter.

A multirotor or multi-copter is a rotorcraft with more than two rotors. Multicopters most often use fixed-pitch blades; control of vehicle motion is achieved by varying the relative speed of each rotor to change the thrust and torque produced by each. Multi-rotors that have four rotors are often referred to as quadcopters or drones. Small versions of quadcopters exist which are commonly referred to as micro-, mini-, or nano-quadcopters wherein the rotors are generally spaced less than 6 inches apart. These small versions of quadcopters are utilized in preferred embodiments of this invention disclosure.

A quadcopter can operate in a head-less mode or standard mode. The standard or regular mode maintains x-y directionality to the drone that distinguishes a forward frontal head from a rear back tail orientation within the drone, independent of user's position. A headless mode does not delineate a front head and back tail of the drone for flight orientation; however, flight orientation is set with respect to user's position. In headless mode, the drone distinguishes flight movement away from and toward the user as a point of reference. Both modes can be utilized within the conception of this invention disclosure.

Multirotor aircraft are frequently used in radio controlled aircraft and UAV projects in which the names tricopter, quadcoper, hexacopter, and octocopter refer to 3-, 4-, 6- and 8 rotor helicopters, respectively. Additionally, coaxial rotors can also be employed, in which each arm has two rotors, running in opposite directions thereby substantially cancelling yaw torque. The present invention may employ any such variant of multicopter configuration as well as a rotocopter with 1, 2, 5, or 7, and up to 12 rotors. Small multicopters are utilized in the context of the current invention, being generally less than 9 inches as measured from each of the closest rotors, and preferably less than 6 inches.

Figure 25:
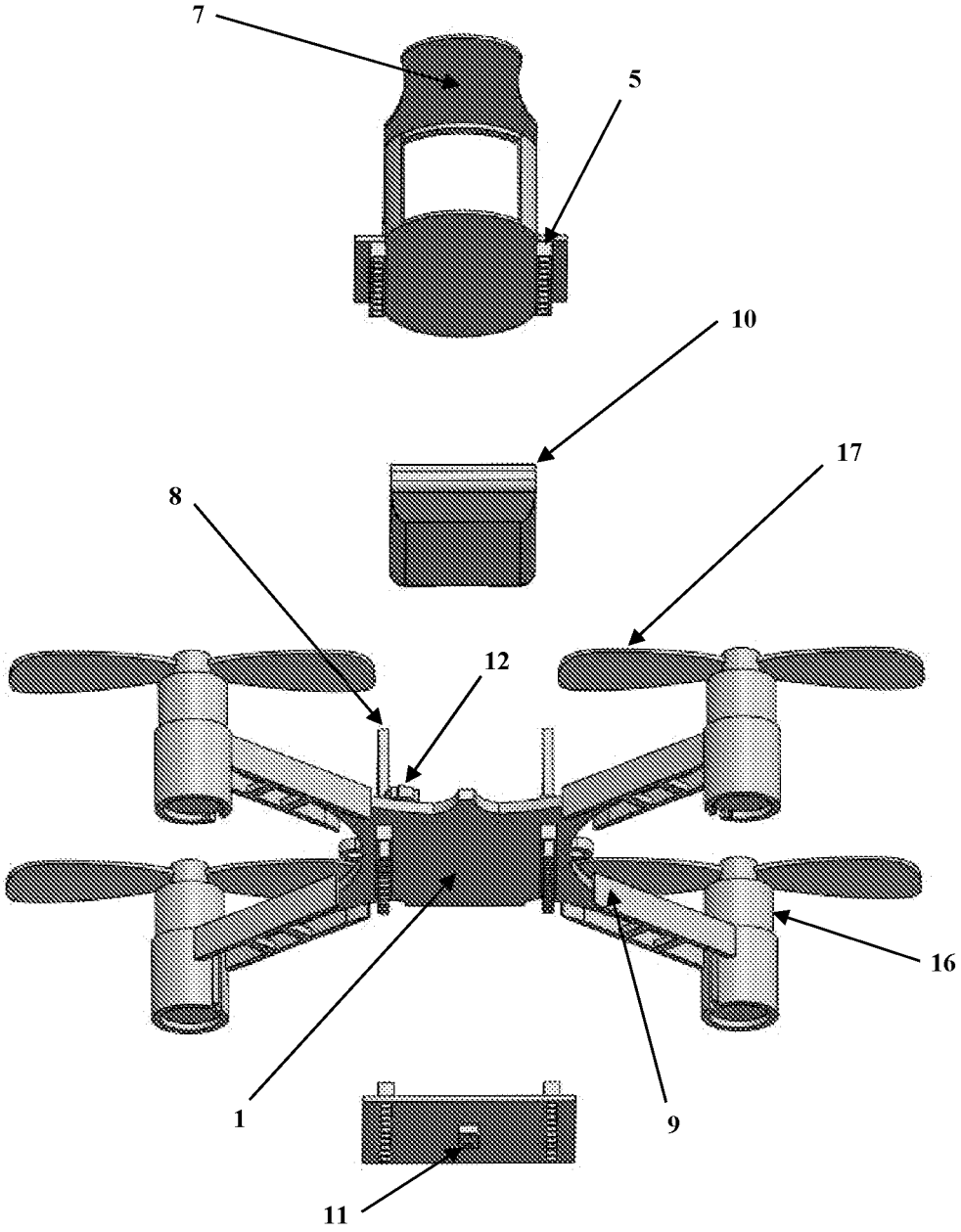
FIG. 25 shows a more fully exploded bottom end tilted view of FIG. 24 depicting connectivity and assembly orientations of the FIG. 5 finger engaging toy element a fitted with battery holder expansion board 5, battery 10, assembled quadcopter, and Z-ranger expansion deck sensor 11.

The components, assembly, use, and configuration of standard multicopters are well known to those versed in the art. Some common components of a standard multicopter include a frame or chassis 9, rotors 16, propellers 17, electronic speed controllers (ESC), flight controller, battery 10, and battery charger as generally depicted in FIGS. 25 and 26. In the various exemplary embodiments the power source may comprise standard non-rechargeable or rechargeable batteries, such as a NiCad, NiMh, or LiPo battery. With respect to the present invention, and in sharp contrast to current multicopter applications, no remote radio control is required for horizontal x-y directional movement of toy assembly. In the present invention, direct finger contact is used to assist in maneuvering the toy assembly in the horizontal xy-planar direction.

The finger contacting toy mounted on the top of the multicopter may take a variety of forms so as to facilitate frictional contact and control of toy assembly movement by finger engagement with said toy. Additional components such as sensors, switches, and cameras may also be employed in the context of this disclosure. Preferred embodiments of the invention utilize sensor(s) attached to the toy assembly to modulate the thrust of attached multicopter to maintain precise height control when in-flight. Additionally, an on-off switch can be mounted on the toy assembly to be hand-activated.

Any embodiments of said invention may optionally employ the use of a ducted cylinder or propeller guards around and/or over each propeller. The top of the cylinder duct can have an outward projecting radial fluted flange to maximize the Coanda effect to increase lift thrust of toy assembly. Flying and hovering small aircraft that utilize the Coanda effect for lift are also conceived within the conception of this invention disclosure.

The Coanda effect is a well-known principle in the aerodynamics of ducted propeller systems to increase lift thrust. This duct also serves a dual purpose in said invention as protection of the spinning propellers. In another preferred embodiment, the finger-contacting platform or toy is part of the multirotor frame and/or propeller guards, which consists of one integrated element of assembly. In a preferred embodiment of the present invention, a small toy with finger-contacting surface is attached to the top side of a multicopter with electronic integrated 3 or 6-axis gyroscopic, 3-axis accelerometer, and/or 3-axis magnetometer, and/or altitude sensor facilitating hover and flight stabilization.

The finger-contacting toy with 3D architecture may be a rimmed platform, or an upward directed concave surface or a cage-like structure, or a combination of such to promote frictional hand-digit engagement for manipulation and trick maneuvering of toy assembly. The topside toy's architectural features may also allow finger(s) to grip toy securely. The miniature flying toy assembly is controlled by direct finger contact on said toy surface and maneuvered by hand thus requiring no external remote control for movement of toy assembly in the horizontal x-y direction. Appropriately oriented sensor technology facilitates a stable hover mode at a preset altitude, or height from toy assembly to ground. The amusement and entertainment utility are derived from pretend play imagination that envisions a small person riding the hover toy by using one's hand digits in frictional engagement with the top elements of the toy.

The upward force on the miniature toy assembly is derived from spinning propellers thrusting air downward away from the multicopter. This upwardly projected propeller force can be guided in the upward z-direction by manual movement, or over countered by downward movement of user's hand via finger engagement with top toy surface. Horizontal movement or x-y axis directional translation of toy assembly is controlled by frictional finger engagement of top toy surface while user moves fingers, hand, arm, and/or walks.

In another embodiment, the finger-contacting platform is part of the multirotor frame thus consisting of one integrated element of assembly. This encompasses a unibody design whereby the multicopter frame and/or contoured top finger placement entity are one contiguous piece. Similarly, the bottom rails and/or propeller guards of toy assembly can be incorporated into one contiguous unibody with the frame of rotocopter and/or finger engaging toy, to maintain the center of gravity THAT is within 5 cm.

The amusement and entertainment utility are derived from the mimicry of a person standing on a hover board or flying surfboard except with one's hand/fingers in contact with the top of the airborne platform. The thrust or upward force of such miniature platform is derived from one or more propellers thrusting air downward via a roto- or multicopter. The upward thrust of the platform facilitates contact with the user's finger tips or thumb positioned on top of said platform allowing frictional translational control of toy through thumb, finger, hand, and arm movement, thus mimicking a levitating surfboard or hover board for one's fingers/hand. Accordingly, as the user's hand is moved either horizontally or vertically, the resultant forces exerted through the fingertip(s) contacting the levitating platform will guide and control movement of the flying toy assembly through the air and allow careening off external objects.

For the purposes of the description of this invention, the deck or platform, refers to the finger contacting element affixed to top side of rotocopter. The finger-contacting toy with 3D architecture may be a rimmed platform, an upward directed concave surface, a cage-like structure, hollow loops, or a combination of such to promote frictional hand-digit engagement for manipulation and trick maneuvering of toy assembly. The topside toy's architectural features may also allow finger(s) to grip toy securely. The finger placement port within the mounted finger toy consists of a 3D architecture that facilitates hand digit control of the entire toy assembly.

Generally, the Z-coordinate measurement of the finger port will be less than 3 inches in depth, and preferably less than 1 inch. The finger engaging port of the topside oriented architecture is optimized for fingertip and/or thumb frictional control of the entire flying toy assembly. Accordingly, the port and/or cage-like architecture is designed to frictionally interact with player's hand digit anatomy containing the distal phalange bone(s) up to the distal inter-phalangeal joint placed within the defining region of finger engaging architecture. The finger engagement area may also incorporate multiple finger ports. Within the horizontally defined space of the finger engagement port(s), an x-y coordinate measurement of generally less than 6×6 inches is preferred. The overall dimensionality of the entire finger toy that includes the area of outside of the finger engagement port(s) can be larger, however; the horizontal x-y width and length are generally each less than 24 inches, and preferably less than 7 inches.

The entirety of the finger engagement toy may incorporate small replicas of animals, flying insects, airborne vehicles, watercrafts, land crafts, or various riding boards that humans stand on. The finger engaging element may be part of the natural contours of the toy, such as an open cockpit on a small airplane as the top oriented finger toy. The top oriented finger toy may also incorporate the quadcopter frame and/or propeller guards in a unibody design. The placement of all parts and frame construction of the entire finger toy assembly is implemented so as to maintain the center of gravity is within 5 cm of where the fingertip(s) are intended to be placed within the frictionally engaged finger port.

Figure 4A:
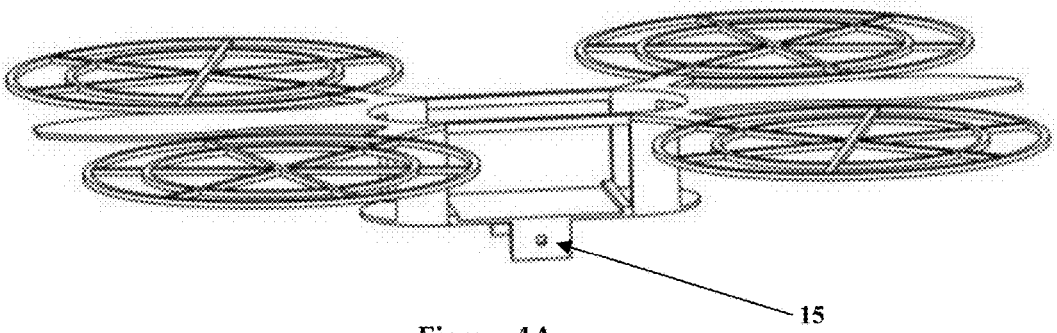
FIGS. 4A-4B illustrate a partly exploded view of the finger engaging toy element with unibody attached propeller guards and quadcopter assembly to depict a preferred interlocking function between the finger engaging toy element hole 15 and the quadcopter peg 19.
Figure 4B:
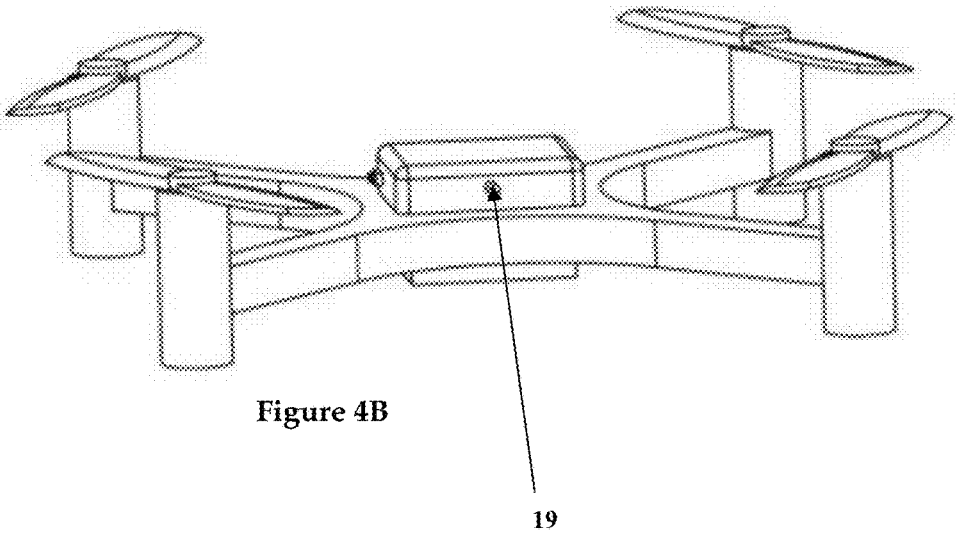
Figure 5:
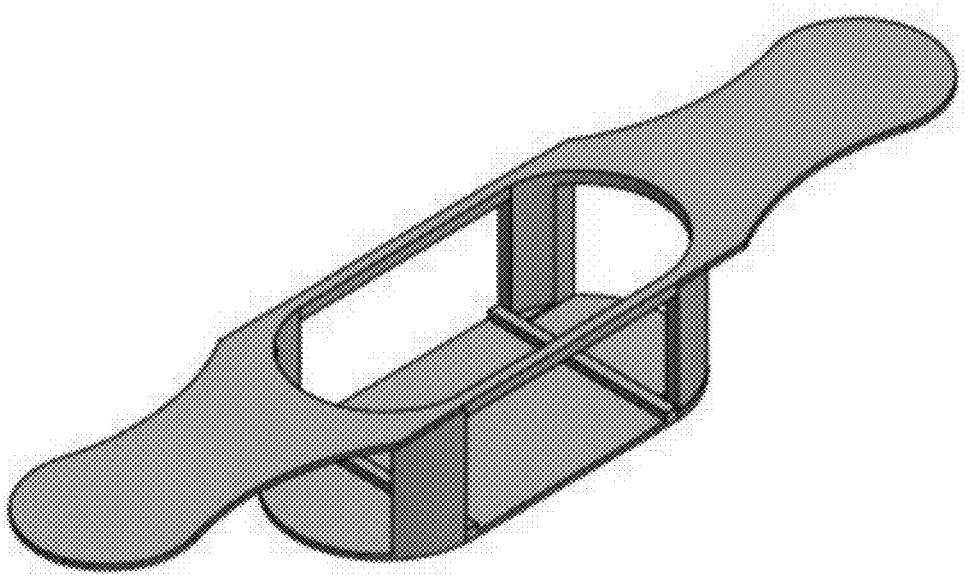
FIG. 5 is a gray-scaled surface isometric view of the finger engaging toy element of FIG. 24.

The toy assembly will have a mode of attachment of the finger contacting toy with the rotocopter. Possible methods of attachment are numerous, and can be by screws, glue, Velcro, peg-in-hole, clips, slid-in-slot, but is not limited to such. The finger-contacting element may be permanently affixed to the top of roto- or multicopter or detachable thus allowing interchange of different configurations of said deck. A preferred method of attachment would implement modes that conveniently facilitate the interchangeability of different finger toys to be affixed to the rotocopter, such as a peg 19 and hole 15 attachment as depicted in FIGS. 1 and 4.

With respect to the finger toy taking the form of a miniature riding board, a generally oblong and/or oval configuration is a preferred embodiment of this invention as it mimics the experience of a standing person riding an airborne surf board or hover board except with one's hands/fingers imitating the standing person. Thus, in preferred embodiments, the finger-contacting toy element is in the general form of an oblong surf-like board with the additional feature of a 3-dimensional finger port. The user's pleasurable imaginary is such that the user pretends a miniature person is on a flying hover board. Accordingly, while hand operating the levitating platform, the user pretends that their hand/fingers represent a small person's body riding a flying hover board.

Thusly, the user's fingers mimic a miniature person's legs standing, finger tips mimic the feet touching the platform, the other non-contact fingers represent the arms, and the palm of the hand is envisioned as the body. Accordingly, the user derives intense amusement and enjoyment by pretending that a miniature person, via their hand, is riding a hover board, skateboard, or surf board capable of airborne flight. This platform or deck description does not limit the scope since alternatively the shape may be a circle or saucer-like configuration. The finger-contacting deck or platform may also have upward curled edges and/or partial non-uniform surfaces, such as concave pockets, sandpaper, and/or ridges to enhance finger control and manipulation to perform aerial and ground tricks.

The nature of the finger engagement element of said deck can also enable fingers to lock on to the deck for optimal toy maneuvering control and override the forces of gravity and propeller induced forces by manual control. The top finger-contacting surface may have a centrally located depressed concave center region where hand digits can be placed for controlling flight and trick maneuvers. Aerial finger tricks include spinning the platform along a vertical axis with the fingertip acting as the axial pivot point on platform. The sideways flick of one's finger can provide the force necessary to start the rotational yaw spinning maneuver while a second contacting finger acts as the rotational center axis. The finger-contacting element may be permanently affixed to top of roto- or multicopter or detachable thus allowing interchange of different configurations of said finger toys.

The bottom of the finger flyer assembly can have rails or guards that facilitate contacting or bouncing on the ground or other external stationary surfaces. These rails or ground guards will provide for stabilization and control when user chooses to hand direct the hovering toy to careen off external objects. This structural concept can take the form of wire runners arching over bottom of unit or small cylindrical enclosure surrounding spinning propellers which extend beyond bottom facial plane of propeller. This will enhance the user experience to be able to manipulate the platform in a matter that further mimics finger skateboarding or surfing acrobatics with the use of one's hand and fingers.

Another preferred embodiment of the invention utilizes a button or switch the turns the multicopter on to activate upward thrust of the toy assembly and is modulated by the downward directed sensor to achieve a preset stabilized altitude. In this embodiment, no radio control is required for operation. No internal or external radio transmitter or receiver elements are present. In one version of this embodiment the button/switch is oriented on the top surface of the finger engagement toy.

Therefore, when the toy assembly is on a substantially level surface and the button or switch is activated, the toy assembly thrusts to provide an upward force on said assembly. If the finger(s) remains on top of toy assembly, then the upward resulting propulsion of toy presses up against said finger(s) and the assemble may be immediately guided in the x-, y-, z-coordinate directions. Alternatively, if the top button/switch is depressed and player's hand is quickly removed in the upward direction, then the toy assembly will rise to the preset altitude as measured by the electronically integrated downward directed time-of-flight infrared sensor and stably hover at preset altitude.

The user may then engage the hovering toy assembly in mid-air by placement of fingers on the top of said assembly wherein the top element is designed to enable frictional contact control of the toy assembly. The player may resume manual controlled flight performing tricks and maneuvers as described in this disclosure. The quadcopter component is optionally programmed to automatically shut off power to rotors when roll and/or pitch tilt angle exceeds a predetermined level. This feature allows for automatic shutdown of flight in situations where the player loses control of toy assembly which can happen especially when performing difficult tricks and maneuvers where the hand is lifted off toy.

For example, when the yaw and/or pitch tilt angle of quadcopter component of the hovering toy assembly exceeds, in a non-limiting example, 80 degrees from the horizontal x-y planar level as sensed by the 3-axis gyroscope and/or 3-axis accelerometer and/or other appropriate internally electronic integrated sensors common to stabilized hovering quadcopters, then a pre-programmed power shutdown will stop all propeller thrust. The 80-degree limit is only one possible preprogrammed power off criterion and shall not preclude other preset angles utilized in the current invention conception. Preferably the point at which the power shutdown would occur may range from 45 to 120 degrees as normal operation of the flying toy assembly would permit slight planar tilt angles of 0 to 45 degrees.

In another preferred embodiment, finger port can also act as a user interface to initiate pre-programmed flight paths and/or trick maneuvers. Accordingly, the act of manually moving the quadcopter by finger induced forces in contact with and inserted into the finger port can be detected by the electronically integrated 3 or 6-axis gyroscopic, 3-axis accelerometer, and/or 3-axis magnetometer, and/or altitude sensor within the multicopter. For example, the multicopter can be manually moved in one or more consecutive yaw like rotations, the first in one direction and the second in the opposite direction.

These finger-induced yaw rotations via insertion of fingers into port that can physically force the multicopter into a yaw rotation may be between 1-360 degrees and would be detected by the electronically integrated flight sensors within multicopter. This informational cue can be set to initiate autonomous pre-programmed flight paths and trick maneuvers with a time delay of between 0 and 30 seconds to allow removal of fingers from finger port and the user's hand away from the top of toy assembly. After the autonomous pre-programmed maneuver has been completed, the flying toy assembly automatically reverts back to the stabilized hover flight mode with preset altitude height to allow user to re-engage and control assembly via finger port insertion.

Another multicopter flight sensory detected informational cue can occur via user's manual movement of toy assembly may be initiated by rocking the multicopter through tilt angles between 0-360 degrees of the x-y horizontal plane. This manually induced pitch and/or roll of multicopter through inserted fingers locking into the port with frictional induced pushing and/or pulling of entire flying toy assembly can also initiate a different type of autonomous flight maneuver. The flying toy assembly may also be consecutively pushed downward and lifted upward, or visa-versa, by fingers locked into finger port and lowering and/or raising hand/arm.

These manually induced motions of toy assembly by user's hand/fingers are detected by the internal multicopter sensor(s) which can initiate autonomous trick flips of toy assembly and/or reset the height the flying toy assembly hovers from the ground or underlying surface. These examples are not meant to limit either the types manual modes of sensory input or types of autonomous maneuvers that are thusly initiated. In another preferred embodiment, the flying toy assembly utilizes a separate radio remote control transmitter that can be held and operated by one hand. Thusly, the flying toy assembly can also be controlled by a wireless system which comprises all the electrical components for operation of the remote-controlled quadcopter.

The wireless control system typically comprises a receiver for receiving signals from a wireless control device, a transmitter for signal transmission, a power source such as a battery, a circuit board, switches, joysticks, buttons, dials, and/or other electronic components and wiring necessary to create wireless connectivity between the transmitter and receiver components between rotocopter of flying toy assembly and wireless controller.

The player's other hand is able to engage the flying finger toy assembly for operational translation in the x-, y-, and z-Cartesian coordinate directions. Generally, radio waves are utilized as the transmission signals in remote controlled rotocopters and are the preferred mode in this disclosure. In one embodiment of this disclosure, the radio remote control (again radio wave and/or optical/laser, be it IR/UV or visible light) can operate using only one to three channels. One channel would be used to initiate upward z-directional thrust of the toy assembly to a preset hover altitude.

Another optional channel with a bidirectional toggle or joystick on the remote control can change the preset altitude by modulating z-directional thrust upward or downward. When the toggle or joystick is replaced at its central neutral position, the altitude of the toy assembly is electronically programmed to reset automatically at its current height as measured by a downward directed sensor 11 on the bottom of said toy. The third radio channel may optionally be used for pre-programmed flips of entire toy assemble while user's hand in not engaged or to initiate yaw-type spinning of toy assembly or to switch to headless flight mode. It is noteworthy that the general use of normal quadcopters requires operation with both hands and requires four or more radio channels to control x-y translation of flight through controlling pitch and roll of the rotocopter, as well as other aspects of flight control.

A unique aspect and part of the novelty of the invention conception herein is that this aspect of complete radio control is not entirely required for operation, since the player's frictionally engaged finger(s) replace these aspects of horizontal x-y directional operation control. However, while additional radio control channels for horizontal translation are not required for x-y translational operation within the context of some embodiments within this invention disclosure, they are also not precluded from additional embodiments, thus are within the intended claims. Additional radio wave remote control channels, greater than 3 channels, are therefore included in further embodiments that can control yaw spinning, and/or headless mode, and/or to initiate toy assembly flips, and/or x-y translational flight via pitch and roll of the quadcopter component of flying toy assembly.

In one embodiment, the invention utilizes a downward directed altitude sensor attached to the rotocopter assembly to measure the distance from the finger hover toy to a surface located under the toy assemble such as the ground. It is further preferred that the sensor is a time-of-flight infrared sensor 11 which contains signal emitting and receiving components. The distance can be set to a predetermined flying altitude (preferably a distance between 0.01 and 2.0 meters) and integrated into the flight controller of the rotocopter to modulate the thrust of propellers to achieve a stabilized hover distance from underlying surface to rotocopter. In the flying hover mode without finger contact of the toy assembly, the toy will hover at the preset altitude to maintain set distance between the ground surface and rotocopter.

When finger(s) are placed on the top deck of flying hover toy to manually move the toy assembly downward below this preset altitude, the upward thrust of the rotocopter is automatically activated thus providing an upward force against finger contact on top deck of toy. This enables the toy to exert an upward force great enough to allow adequate frictional contact with the platform and fingertips positioned above, so as to enable the user to maneuver and direct the flying toy in the horizontal and vertical directions. Additionally, the user may remove fingers from the top of toy deck and the flying toy will automatically re-adjust to the preset stabilized hover altitude.

Upon re-engaging the top deck of toy by replacing finger(s) thereon, and manual movement of the flying toy assembly downward, the upward thrust against finger(s) will resume. It is noteworthy that if the fingers are lightly resting on the deck at the preset hover altitude, the frictional force of the side rails of the finger port can be primarily engaged to manipulate the flying finger toy. These steps allow the user's hand to jump on and off the small hover craft while maintaining continuous airborne toy flight. The thrust modulation is an automatic attribute of sensor altitude detection integrated into the electronic flight controller. Thusly, when the distance from the downward directed sensor on the bottom of toy assembly to a surface below exceeds preset height, the thrust is decreased resulting in a drop in altitude back to the preset hover height.

Conversely, when the distance from sensor 11 to underlying surface is less than the preset height, the thrust automatically increases. The resulting increased thrust works to propel the toy assembly upward to the preset altitude when the user is not in contact with said assembly so that the flying finger toy assembly may return to the predetermined height. And in the case where there is user finger contact on top deck of toy assembly and altitude is below the preset level, the resultant upward force of toy assembly facilitates frictional contact with user's fingers. In a further embodiment of this invention, the degree of upward thrust force can also automatically be programmed to change based on the difference between the preset altitude, and the actual detected distance from sensor to surface below.

Accordingly, a higher thrust can be pre-programmed to automatically propel toy assembly upward with greater force when this difference is greater than a certain predetermined value. Therefore, if the toy assembly is close to the bottom external surface, and far from preset equilibrium altitude, the upward propulsion force would be greater than the case where the toy assembly is close to the preset altitude. This pre-programmed ability to change the magnitude of upward thrust, based on the actual distance from sensor on toy assembly to the external surface below, enables the user while in finger engaged contact with top deck, to manually direct the toy assembly downward to increase the upward thrust of said assembly.

The increased upward thrust force against user's fingers results in an increased frictional contact with top deck of toy assembly to facilitate tricks and maneuvers. In addition, the decreasing upward thrust as the user manually allows the toy assembly to rise closer to the preset altitude facilitates finger disengagement of toy as the hand is moved upward off and away from top of toy deck. The toy assembly thus smoothly stabilizes at the preset altitude and hovers without user contact with said assembly.

An active proximity sensor is a sensor able to detect the presence of nearby objects without any physical contact and has both signal receiver and emitter components. A proximity sensor often emits an electromagnetic field or a beam of electromagnetic radiation (infrared, for instance), and determines any changes in the field or return signal. The object being sensed is often referred to as the proximity sensor's target. There are various technologies for proximity sensing: Electrical (Inductive, Capacitive), Optical, (IR, Laser), Magnetic, and Sonar are some examples.

Such sensors may also have separate signal receiver and transmitter components to detect signal interference of a target between these components. Sensors may also detect signals reflected from an external target, or signals naturally emitted from a target, such as a human body emitting infrared radiation. Of these, the most non-intrusive and low-cost modules are the optical proximity sensors. All can be used within the context of this invention disclosure, but are not limited to such.

The foregoing embodiments are merely representative of the finger flying toy hovercraft and not meant for limitation of the invention. For example, persons skilled in the art would readily appreciate that there are several embodiments, configurations, combinations of deck or platform configurations, multiple and differentially rotating propellers, and power activating switch/sensor mechanisms and other components will not substantially alter the nature of the finger flying toy hovercraft. Likewise, elements and features of the disclosed embodiments could be substituted or interchanged with elements and features of other embodiments, as will be appreciated by an ordinary practitioner.

Consequently, it is understood that equivalents and substitutions for certain elements and components set forth above are part of the invention described herein, and the true scope of the invention is set forth in the claims below. For example, the electric engines may be mounted with propellers on the top or bottom of engine as long as air movement is substantially downward to lift flying toy assembly. Likewise, additional known elements to the present invention which captures the novel utility of disclosed invention are also within the described scope.

For example, although radio wave remote control transmission and receiver elements are not a requirement of said invention, addition of such elements with the intended capabilities to enable a finger flying multicopter toy assembly as herein described should be viewed as within the scope of this disclosure. In addition, the orientation and type of sensor(s) are variable with respect to emitter, receiver, and directional orientation to achieve flight objectives as described for invention.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description refrains from repeating every possible combination of the individual steps in an unnecessary fashion. Nevertheless, the specification and claims should be read with the understanding that such combinations are entirely within scope of the invention and the claims.

Reduction to Practice Working Prototype

Example 1

The following described example of a working prototype of one embodiment of said disclosed invention utilizes a quadcopter 1 that is called by the brand name, Crazyflie 2.0. The Crazyflie 2.0 is a versatile, open sourced development platform used by researchers and inventors around the world. The internal hardware includes a 3-axis gyro, a 3-axis accelerometer, and a 3-axis magnetometer. It is relatively small and lightweight, weighing around 27 g and fits in the palm of your hand. The quadcopter is commercially available to the public by Bitcraze.io and seeedstudios.com; it can be found and purchased over these publicly accessible internet sites as well as many others. The full description and instructions for use, assembly, supporting infrastructure, downloadable programs as well as connectivity to laptop computer 2, gamepad 3, and 2.4 GHz radio USB dongle 4 are fully elaborated via these public internet sites. The application to the current invention will be briefly discussed in the main attributes that enable the herein described working prototype; however, it is not intended to be exhaustive or limiting in any respect. It is only intended as a guide, and to facilitate, those skilled in the art in building one possible working embodiment of the current claimed invention. The herein disclosed invention description, taken together with this example of a working prototype, shall be fully adequate for those skilled in the art to enable reproduction of said invention. This working prototype can perform all the claimed tricks and maneuvers elaborated in this invention disclosure.

Figure 6:
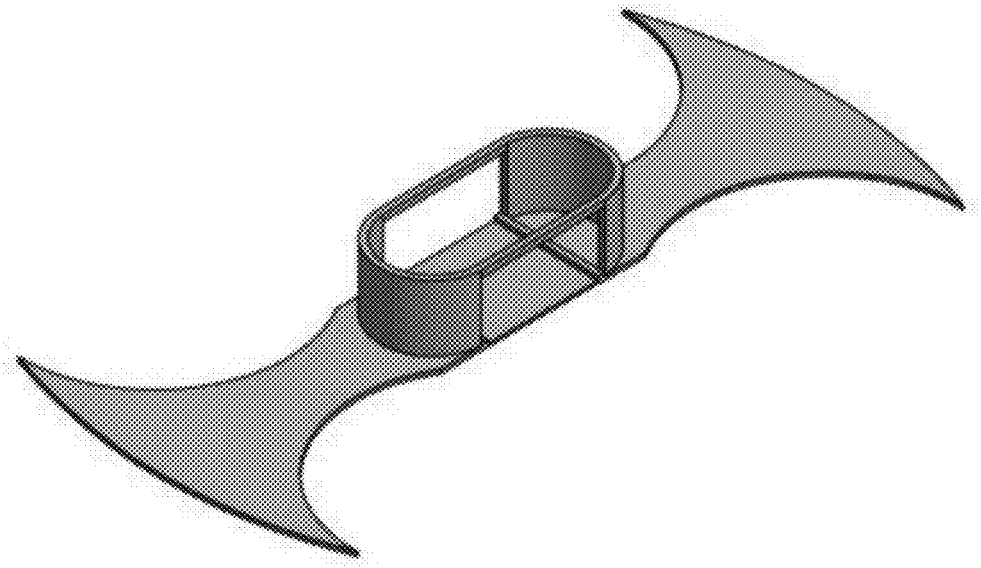
FIG. 6 is a gray-scaled surface isometric view of the finger engaging toy element of FIG. 23.
Figure 9:
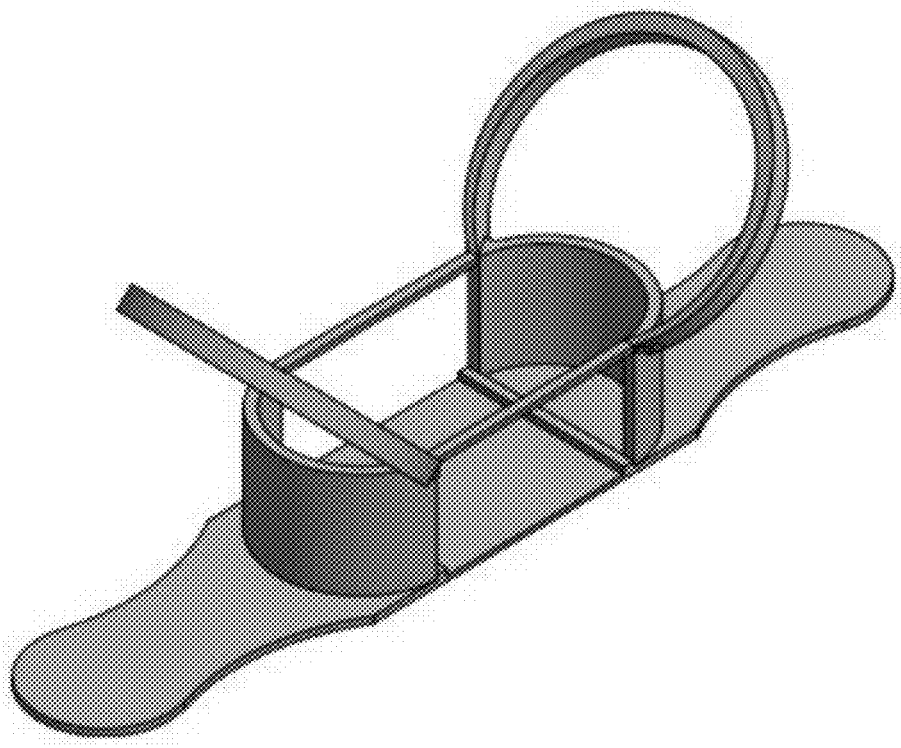
FIG. 9 is a gray-scaled surface isometric view of an alternative mono-level finger engaging toy element featuring a unibody attachment of extended rings for easier initial capture and control.
Figure 10:
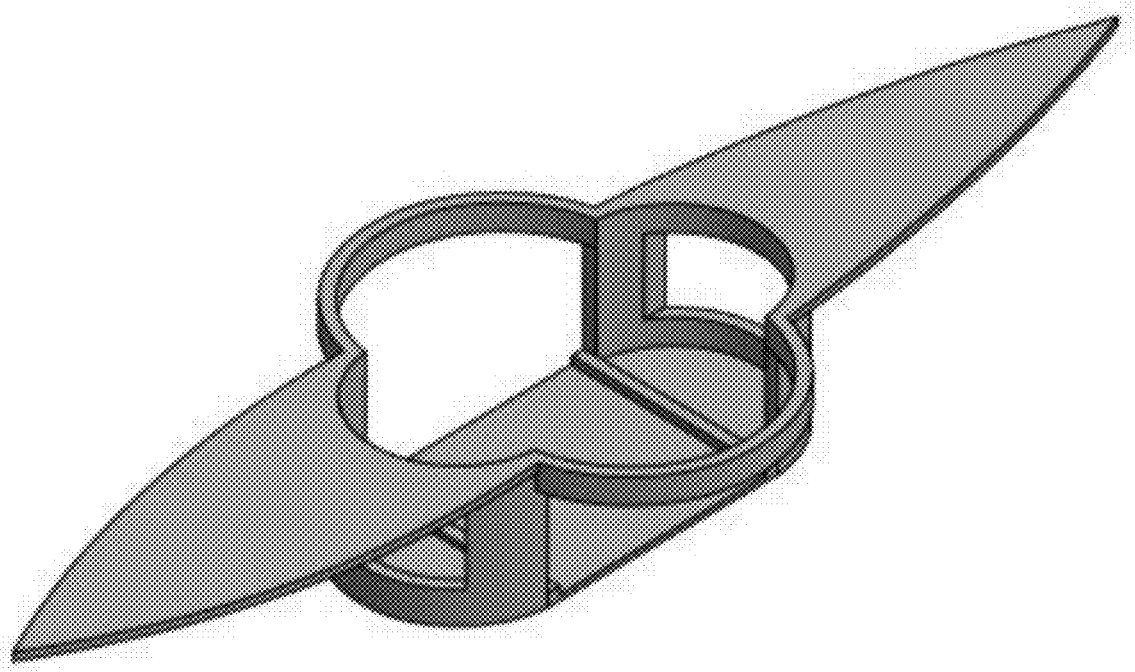
FIG. 10 is a gray-scaled surface isometric view of an alternative bi-level finger engaging toy element.
Figure 17:
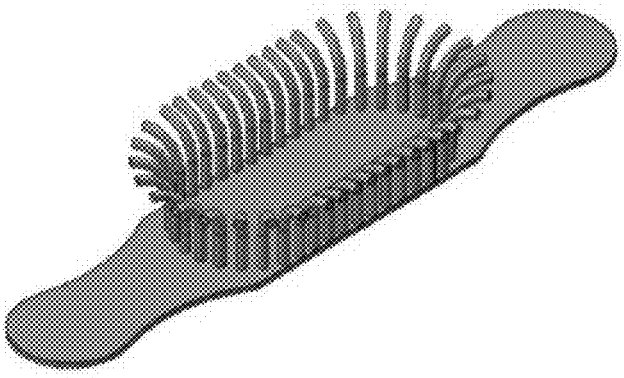
FIG. 17 is a gray-scaled surface isometric view of an alternative mono-level finger engaging toy element.
Figure 18:
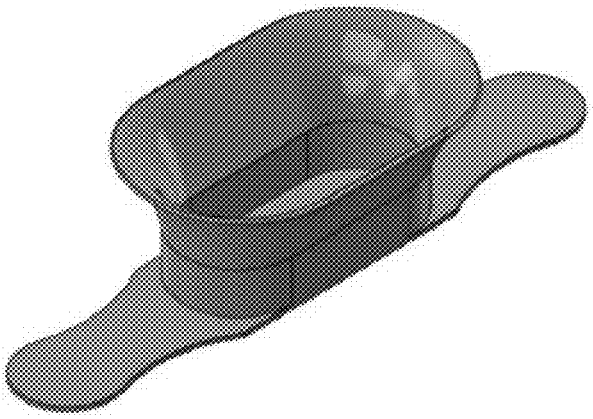
FIG. 18 is a gray-scaled surface isometric view of an alternative mono-level finger engaging toy element.
Figure 19:
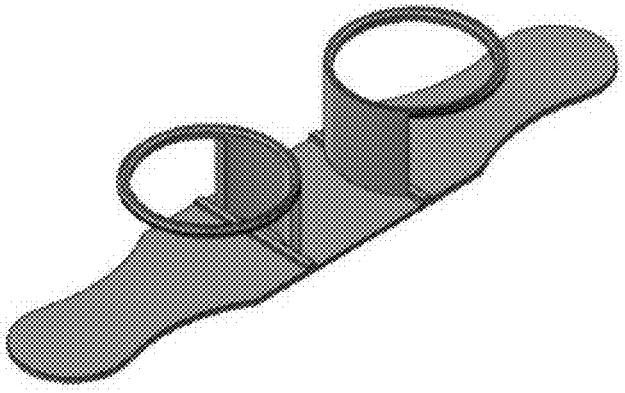
FIG. 19 is a gray-scaled surface isometric view of an alternative mono-level finger engaging toy element.
Figure 23:
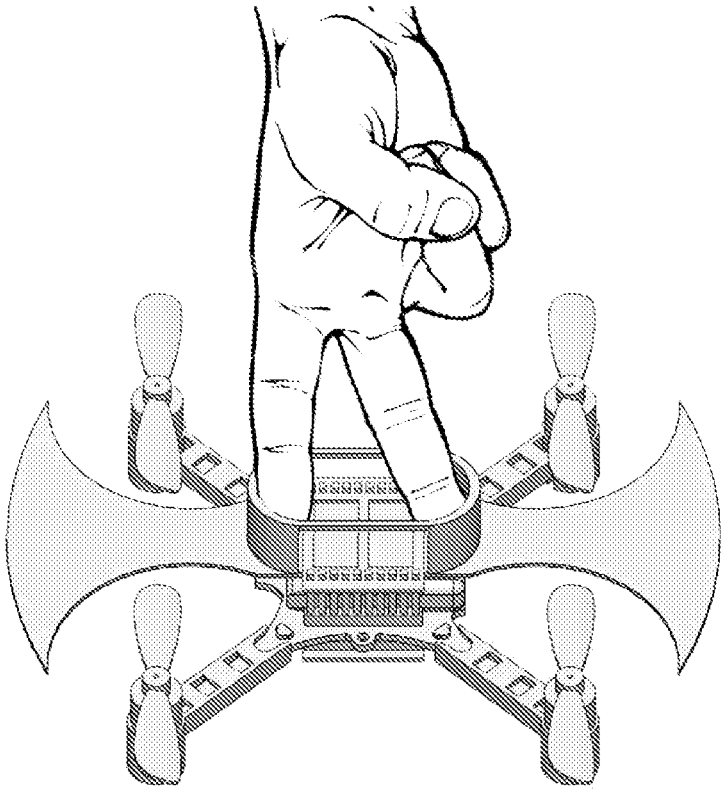
FIG. 23 is a side elevation view of a finger engaged flying hover toy assembly in accordance with a preferred embodiment of the present invention.
Figure 24:
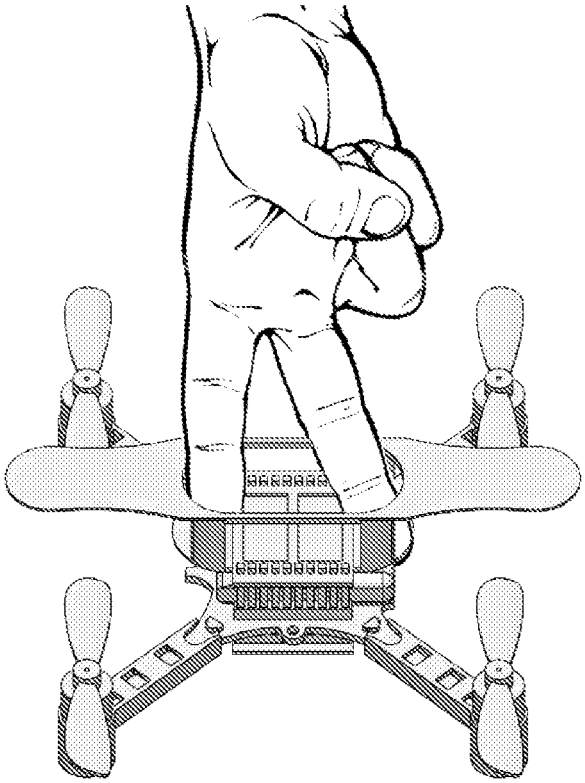
FIG. 24 is a side elevation view of a finger engaged flying hover toy assembly in accordance with a preferred embodiment of the present invention.
Figure 28:
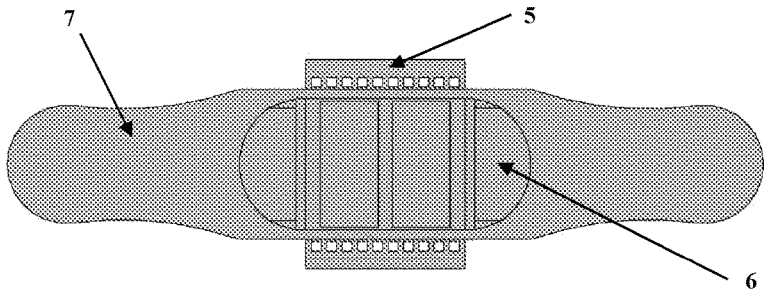
FIG. 28 is a top view of battery holder expansion board 5 fitted over smaller bottom deck 6 of finger engaging toy of FIG. 5.
Figure 29:
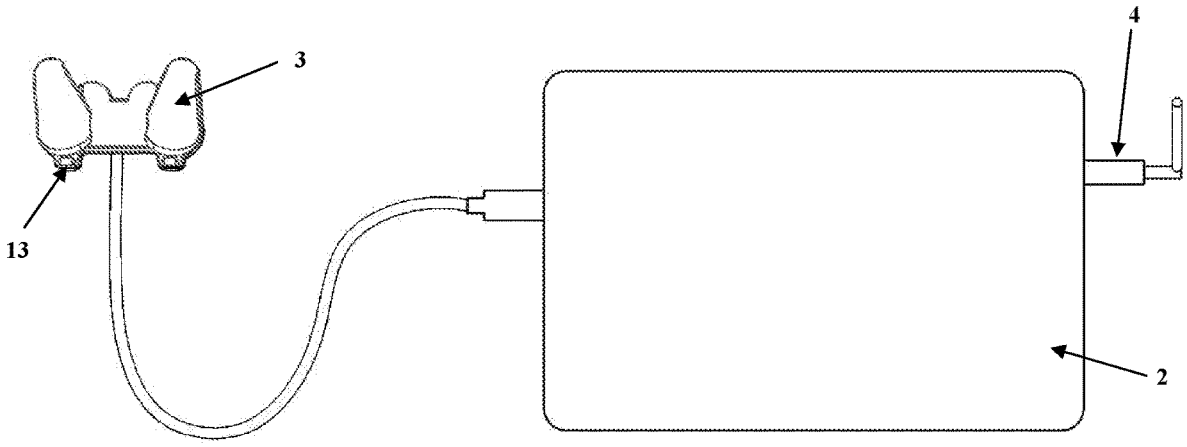
FIG. 29 is a direct elevated view of Laptop 2 connectivity with USB radio dongle 4 (Crazyradio PA) and USB gamepad 3 (PlayStation 3 Wired Controller by @Play).

Thusly, one non-limiting example of a working prototype utilizes the 3-D printed (designed and produced via Autodesk Inventor® 3D CAD software and a Makerbot Replicator 3D printer) plastic finger engaging toy element of FIG. 6 connected to the top of a CrazyFlie 2.0 quadcopter via insertion of the battery holder expansion board 5 into middle deck section and fitted over the smaller bottom deck section 6 of the finger engaging toy 7 as depicted by FIGS. 27 and 28. The two rows of holes in the battery holder expansion board 5 with finger engaging element are then inserted into the two rows of long expansion connector pins 8 (2×10, 2 mm spacing, 14 mm long) fitted to the top-side of the CrazyFlie frame 9 as depicted in FIG. 26, thereby securing the finger engaging component to the quadcopter.

The battery 10 is sandwiched between the finger engaging top element and the top of the quadcopter circuit board frame. The bottom side of the Crazyflie 2.0 quadcopter is equipped with a Z-ranger deck board 11 which contains a VL53L0x Time-of-Flight (ToF) laser-ranging sensor and has a 1-wire memory which enables the Crazyflie 2.0 to automatically detect the Z-ranger deck. The sensor can measure the distance up to 2 meters from the Crazyflie 2.0 to the ground and is installed on the bottom of the Crazyflie 2.0.

In this enablement, a laptop computer 2 (Dell Precision 7520) with a Windows 10 Pro operating system is used with a 2.4 GHz USB radio dongle with antenna 4 that enables communication between the host and the Crazyflie 2.0 and a gamepad 3 with USB connection (PlayStation 3 Wired Controller by @Play). The brand name of the radio dongle used is Crazyradio PA which is also available publicly as is the required installation of a driver for the Crazyradio PA USB Dongle downloadable from the Zadig-Akeo web site. The downloaded file used is: Zadig 2.3 (4.9 MB), with additional details and instructions for installation that are explained on the internet.

A Python client that's available for Windows through public websites that sell Crazyflie 2.0 is used to set up a connection with the quadcopter. cfclient-win32-install-2017.06.exe is the file version of the python client that is used. In the client, the height-hold mode is chosen from the drop-down menu next to the assist mode designation found under the flight control tab. The quadcopter is partially controlled by a gamepad connected to the computer and is mapped or configured inside the client. The Z-ranger is set to flight hold mode which stabilizes the quadcopter to a height of 40 cm as per the default setting.

The Crazyflie 2.0 is placed the floor in an area with enough floor space for hovering and a small on/off switch 12 is activated on the Crazyflie 2.0 quadcopter frame, then the assisted mode button 13 is depressed on the gamepad to activate the height-hold mode. The toy assembly takes off and hovers at a height of 40 cm. The previously mapped assisted mode button 13 is continually depressed on the gamepad 3 to activate the height-hold mode, and within the conception of this disclosed invention, the pitch and roll joystick modes for horizontal x-y coordinate translation are not required for operation; however, their addition is not precluded.

While keeping the assist mode button 13 depressed with one hand, and with the quadcopter stably hovering, the fingers 18 of the other free hand may engage the finger port 14 of the finger toy on the top of the quadcopter. The user can then manually move the flying toy assembly in the horizontal and/or vertical directions. While manually translating the toy assembly in the horizontal x-y direction, the user may remove one's hand digit(s) 18 from the attached finger toy 7 and the flying toy assembly continues in its manually directed horizontal trajectory without finger engagement.

The user may then reengage the flying toy assembly by replacing fingers 18 back onto the top attached finger toy element. Alternatively, another separate user may reengage the flying toy assembly while moving horizontally through the air in a similar fashion. The toy assembly may therefore be passed between players by following this procedure. The player may also remove hand from top of toy assembly while airborne and swipe the same hand underneath the hovering assembly in the pathway of the Z-ranger's optical scanning region, thus causing a momentary upward thrust jump of the toy assembly in the vertical direction.

The toy assembly will then drop downward to the preset height when hand is removed from the bottom vicinity of Z-ranger, and user may again reengage the fingers in the top of toy. Additionally, the user may engage the finger toy with two hand digits and flick the fingers in opposite directions while simultaneously lifting fingers from the top of toy assembly. This maneuver creates a manually induced yaw torque on the flying toy assembly which spins it around a vertical central oriented z-axis in mid-air flight. In non-headless or standard mode, the quadcopter creates a slight resistance to the manually induced yaw which is easily overcome.

As the manually induced yaw spin completes turning, the quadcopter automatically returns to the front/back x-y directional orientation as originally set position in the non-headless mode. The player may also, while engaging the top finger toy with two fingers, lift and flick one finger against the edge of the toy deck while lifting said finger up out of the finger engagement area keeping the other finger in top toy contact. Accordingly, the flying toy assembly proceeds to yaw rotate around the remaining finger oriented in the top of the toy. Afterward, the player may reengage the previously removed finger by replacing back on top of the toy deck and continue manual control of toy assembly.

Another trick involves giving a vertical downward push with user's fingers engaged in top of airborne toy and subsequently lifting user's hand from the top of toy. Accordingly, the toy assembly proceeds downward until the quadcopter automatically thrusts back up to the predetermined set hover height facilitated by the Z-ranger sensor attached to the bottom of toy assembly. The player thus experiences the thrilling effect of their hand mimicking a small person flying a miniature hovercraft with the ability to perform tricks and maneuvers that exhilarate the imagination.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

The invention claimed is:

1. A hand controlled flying toy comprising:

a frame, a finger engagement port, well, dock, tab, post, ring, or cavity with top and/or bottom elements linked to said frame and having spatially defined finger insertion dimensions in height, length, width and/or radius, so that frictional contact can occur concurrently with fingertip(s) and with the upper phalangeal regions below the proximal interphalangeal joint(s) of inserted hand digit(s);

one or more mounted electric motors mechanically linked to one or more spinning propeller(s), including required circuitry, gyroscope(s), accelerometer(s) and/or magnetometer(s), integrated with an Inertial Measurement Unit (IMU), flight controller, electronic speed controller and/or any other necessary component(s) required for stabilized hover flight;

one or more mechanical component(s) for attachment connecting said finger port, dock, tab, post, ring, well, or cavity in an upward orientation onto top-side of rotocopter so that finger insertion and gripping can occur from top of the flying toy assembly;

one or more sensors mounted on said flying toy oriented for detection of external object surfaces and integrated into said flight controller for thrust control modulation;

a power switch and/or sensor(s) to turn on engine propeller(s) to activate and/or facilitate flying mode; and wherein the attachment of deck to the frame occurs securely in such a way as to not allow rotation of said deck relative to said frame.

2. A hand controlled flying toy comprising:

a frame, a finger engagement port, well, dock, tab, post, ring, or cavity with top and/or bottom elements linked to said frame and having spatially defined finger insertion dimensions in height, length, width and/or radius, so that frictional contact can occur concurrently with fingertip(s) and with the upper phalangeal regions below the proximal interphalangeal joint(s) of inserted hand digit(s);

one or more mounted electric motors mechanically linked to one or more spinning propeller(s), including required circuitry, gyroscope(s), accelerometer(s) and/or magnetometer(s), integrated with an Inertial Measurement Unit (IMU), flight controller, electronic speed controller and/or any other necessary component(s) required for stabilized hover flight;

one or more mechanical component(s) for attachment connecting said finger port, dock, tab, post, ring, well, or cavity in an upward orientation onto top-side of rotocopter so that finger insertion and gripping can occur from top of the flying toy assembly;

one or more sensors mounted on said flying toy oriented for detection of external object surfaces and integrated into said flight controller for thrust control modulation;

a power switch and/or sensor(s) to turn on engine propeller(s) to activate and/or facilitate flying mode; and wherein the attachment mode of finger port deck to the frame or rotocopter allows for horizontal rotation of said deck plane relative to frame or rotocopter.

3. A method for using a hand controlled flying toy comprising;

placing one or more fingers within port top of deck attached to rotocopter;

activating electric engine propeller(s) to levitate toy assembly in a stabilized hover flight;

placing at least one finger within the port on deck of levitating toy, enabling frictional contact and mechanical engagement of toy assembly thereby facilitating hand movement control of flying toy in horizontal and vertical directions;

using one or more contacting fingers within port to control and actuate the airborne flight movements of hovering toy by body motion of hand, wrist, arm, and/or walking, including the optional spinning of said toy assembly horizontally around an axis defined by contacting finger, or without finger contact through central z-axis of hovering toy; and hand/arm directing the finger-contacted hover toy to careen, bounce, and/or slide off external objects.

4. The method of claim 3 further comprising;

contact of two or more fingers within port on top deck to resist yaw torque in the case that all or most of the engine propellers are spinning in the same direction then with subsequent lifting of all but one finger allows torque inducted yaw rotation of toy around axis of finger;

in the case where an equal number of engine propellers are spinning in opposite directions, thus cancelling out yaw induced torque on said toy, starting with two fingers within port on top deck, user gives horizontal finger flick movement with frictional engagement of port across deck while maintaining one finger on deck results in a user induced yaw spin of the toy around a remaining contacted finger, or removal of fingers to send the hovering toy assembly into a yaw rotation;

while one of more fingers are in contact within port on top deck in the upward thrust flying mode, removal of all fingers and hand from vicinity of top deck while flying toy is in stabilized altitude hover mode allowing subsequent replacement of hand/fingers on within port on top deck to regain frictional contact and hand movement control of flying toy;

while one or more fingers are inserted into port on top deck, while in the upward stabilized hover flying mode, user can frictionally push flying toy thus translating entire assembly in a horizontal direction, and when user removes hand, flying assembly reverts to automatic stabilized hover altitude while toy continues in its user induced horizontal trajectory without any fingers in contact with toy thus enabling the user to pass the toy to another user who can reengage the flying toy assembly when second user inserts their fingers into port thus completing an in-flight hand-off of the toy from user to another while in continuous airborne flight; and while in stabilized hover mode with finger port contact, user may direct flying toy assembly downward by overcoming upward thrust to skid, bounce, or careen off external objects—such as table, ground or floor—using the bottom guards as toy contact element.

5. The method of claim 3 further comprising;

while user has finger(s) locked into port of flying toy assembly in stabilized hover mode, user forces entire toy assembly into a predetermined set of motions that are detected by the onboard inertial measurement unit as an input to initiate preprogrammed autonomous flight paths and/or flying trick maneuvers and/or resetting of hover height from ground, while user removes hand from top of flying toy assembly; and after said preprogrammed autonomous flight paths and/or flying trick maneuvers are completed, flying toy assembly automatically reverts to stabilized hover mode wherein the user may reengage control by inserting or docking fingers into port.

* * * * *